US010794030B2

(12) United States Patent
Kemp et al.

(10) Patent No.: US 10,794,030 B2
(45) Date of Patent: Oct. 6, 2020

(54) SUPPORTS FOR HELICAL PILES AND ANCHORS

(71) Applicant: Hubbell Incorporated, Shelton, CT (US)

(72) Inventors: Timothy Michael Kemp, Columbia, MO (US); Shawn David Downey, Columbia, MO (US); Daniel V. Hamilton, Centralia, MO (US)

(73) Assignee: HUBBELL INCORPORATED, Shelton, CT (US)

( * ) Notice: Subject to any disclaimer, the term of this patent is extended or adjusted under 35 U.S.C. 154(b) by 0 days.

(21) Appl. No.: 15/826,271

(22) Filed: Nov. 29, 2017

(65) Prior Publication Data

US 2018/0148901 A1 May 31, 2018

Related U.S. Application Data

(60) Provisional application No. 62/427,699, filed on Nov. 29, 2016.

(51) Int. Cl.
*E02D 27/12* (2006.01)
*E02D 5/22* (2006.01)
*E02D 5/56* (2006.01)

(52) U.S. Cl.
CPC ..... *E02D 5/223* (2013.01); *E02D 5/56* (2013.01)

(58) Field of Classification Search
CPC ..... E04H 12/2215; E04H 17/22; E02D 27/12; E02D 35/00; E02D 5/28; E02D 27/50; E02D 27/16; E02D 5/801; E02D 5/56; Y10T 403/55; F16B 2200/10
See application file for complete search history.

(56) References Cited

U.S. PATENT DOCUMENTS 277,708 A * 5/1883 Gorla ..... E04H 12/2215 52/154
287,923 A * 11/1883 Gorla ..... E04H 12/2215 52/154
1,964,250 A 6/1934 Countryman
3,312,488 A * 4/1967 Lickliter ..... E04B 9/067 403/263
3,342,444 A 9/1967 Nelson
3,727,357 A 4/1973 Stillman
4,252,472 A 2/1981 Moraly
4,833,846 A * 5/1989 McFeetors ..... E04H 12/20 52/154
5,575,122 A * 11/1996 Hamilton ..... E02D 5/801 405/253

(Continued)

FOREIGN PATENT DOCUMENTS

EP 0040326 11/1981

OTHER PUBLICATIONS

International Search Report and Written Opinion mailed in corresponding International Application PCT/US2017/063745 dated Feb. 8, 2018.

(Continued)

*Primary Examiner* — Gisele D Ford
(74) *Attorney, Agent, or Firm* — Wissing Miller LLP

(57) ABSTRACT

The present disclosure provides a lateral support for a shaft of a helical pile, the lateral support including a tubular portion for receiving the shaft and a plurality of fins extending from the tubular portion.

14 Claims, 29 Drawing Sheets

(56) References Cited

U.S. PATENT DOCUMENTS 5,607,261 A * 3/1997 Odom ..... E02D 5/801 405/244
5,647,557 A 7/1997 Faulkner
6,074,133 A * 6/2000 Kelsey ..... E02D 27/12 405/244
6,263,622 B1 * 7/2001 Griffin ..... E02D 5/801 52/153
7,165,915 B2 1/2007 Queen
7,241,079 B2 7/2007 Francis
7,942,612 B1 5/2011 Willison
8,156,695 B2 * 4/2012 Smith ..... E02D 5/28 52/154
8,888,413 B2 * 11/2014 Seider ..... E02D 5/523 405/229
9,453,318 B2 * 9/2016 Kemp ..... E02D 5/56
9,879,444 B2 * 1/2018 Gibbs ..... E04H 12/2215
10,030,347 B2 * 7/2018 Kemp ..... E02D 5/801
2007/0000187 A1 * 1/2007 St. Onge ..... E02D 5/74 52/157
2009/0293379 A1 * 12/2009 Smith ..... E02D 5/28 52/154
2011/0020068 A1 1/2011 Kelly
2011/0185649 A1 * 8/2011 Lin ..... E02D 5/801 52/157
2013/0121772 A1 * 5/2013 Karsten ..... E02D 5/80 405/259.1
2016/0186402 A1 6/2016 Tomchesson et al.
2016/0215470 A1 7/2016 Reusing et al.

OTHER PUBLICATIONS

International Preliminary Report on Patentability mailed in corresponding International Application PCT/US2017/063745 dated Jun. 13, 2019.

* cited by examiner

SUPPORTS FOR HELICAL PILES AND ANCHORS

CROSS REFERENCE TO RELATED APPLICATIONS

The present application is based on and claims benefit from U.S. Provisional Application Ser. No. 62/427,699 filed Nov. 29, 2016 entitled "Supports for Helical Piles and Anchors" the entire contents of which are incorporated herein by reference.

BACKGROUND

Field

The present disclosure relates generally to supports, and more particularly to lateral supports for helical piles and anchors.

Description of the Related Art

Piles are used to support structures, such as buildings, towers, etc., when the soil underlying the structure would be too weak alone to support the structure. To effectively support a structure, a pile has to penetrate the soil to a depth where competent load-bearing stratum is found. Conventional piles can be cast in place by excavating a hole in the place where the pile is needed, or a hollow form can be driven into the ground where the pile is needed, and then filled with cement. These approaches are cumbersome and expensive.

Helical or screw anchors/piles are a cost-effective alternative to conventional cement piles because of the speed and ease at which a helical pile can be installed. A helical pile is an extendable foundation system having helical bearing plates welded to a central steel or galvanized steel shaft or lead. Load is transferred from the shaft to the soil through the helical bearing plates. Helical piles are rotated such that load bearing helical plates at the lower end of the pile effectively screw the pile into the soil to a desired depth. Depending on the soil conditions, after the pile is installed portions of the steel shafts, particularly portions near the surface stratum and/or other layers, may provide little or no lateral support.

Accordingly, a need exists for a way of improving lateral support for helical piles to prevent or minimize lateral shift of the pile once installed. In addition, a need exists for a way of utilizing the helical piles to provide a level surface for supporting a structure such as, for example, a platform once the pile is installed.

SUMMARY

In one illustrative embodiment, a lateral support for a shaft of a helical pile is described. The lateral support comprises a tubular portion for receiving the shaft and a plurality of fins extending from the tubular portion.

In another illustrative embodiment, a structure for providing lateral support for a shaft for a helical pile is described. The structure comprises a plurality of interlocking members, each interlocking member comprising a receiver and a coupling, wherein the receiver of each interlocking member is dimensioned for receiving a coupling of another interlocking member.

In another illustrative embodiment, a lateral support for a shaft for a helical pile is described. The lateral support comprises a plurality of interlocking plates and a plurality of fins for providing lateral support.

According to an illustrative embodiment, a support for supporting a structure utilizing a helical pile is described. The support comprises a support plate, a mount for mounting the support plate to the helical pile and an adjuster for adjusting a height of the support plate relative to the helical pile.

BRIEF DESCRIPTION OF THE DRAWINGS

A more complete appreciation of the present disclosure and many of the attendant advantages thereof will be readily obtained as the same becomes better understood by reference to the following detailed description when considered in connection with the accompanying drawings, wherein.

DETAILED DESCRIPTION

The following exemplary embodiments are set forth to aid in an understanding of the subject matter of this disclosure, but are not intended, and may not be construed, to limit in any way the claims which follow thereafter. Therefore, while specific terminology is employed for the sake of clarity in describing some exemplary embodiments, the present disclosure is not intended to be limited to the specific terminology so selected, and it is to be understood that each specific element includes all technical equivalents which operate in a similar manner.

An illustrative embodiment of the present disclosure provides a lateral support structure for a lead shaft and/or extension shaft of a helical pile. The lateral support structure includes a tubular portion for receiving the shaft and a plurality of fins extending from the tubular portion. The fins provide lateral support to the helical pile when the helical pile is screwed into the earth. According to embodiments of the present disclosure, the lateral supports may be fabricated from steel, galvanized steel, stainless steel, or any other suitable alloy. The lead shafts and extension shafts for helical piles are generally fabricated from steel, galvanized steel. The terms lead and shaft may be used interchangeably in the present disclosure.

According to an illustrative embodiment of the present disclosure, the lateral support structure may be utilized on a lead shaft or extension shaft of a helical pile for providing lateral support to the pile shaft. The lateral support structure may be utilized on both hollow and solid shafts. The shafts may have various shapes including round, square, etc. According to an illustrative embodiment of the present disclosure, a lateral support structure may be formed from three interlocking plates. When interlocked, the plates form a tubular center portion for receiving the shaft. The tubular center portion is dimensioned such that the shaft is rotatable therein while the lateral support structure remains stationary. Once applied on the shaft, the interlocking plates cannot be disassembled without removing the shaft.

An illustrative embodiment of the present disclosure provides a structural support surface for supporting a structure. The structural support surface may include a generally flat plate and a jack plate assembly for mounting the flat plate to a helical pile. The jack plate assembly includes a mount for attachment to a helical pile, a threaded jack screw and a threaded plate movable relative to the threaded jack screw. The threaded plate movably supports the generally flat plate.

Figure 1:
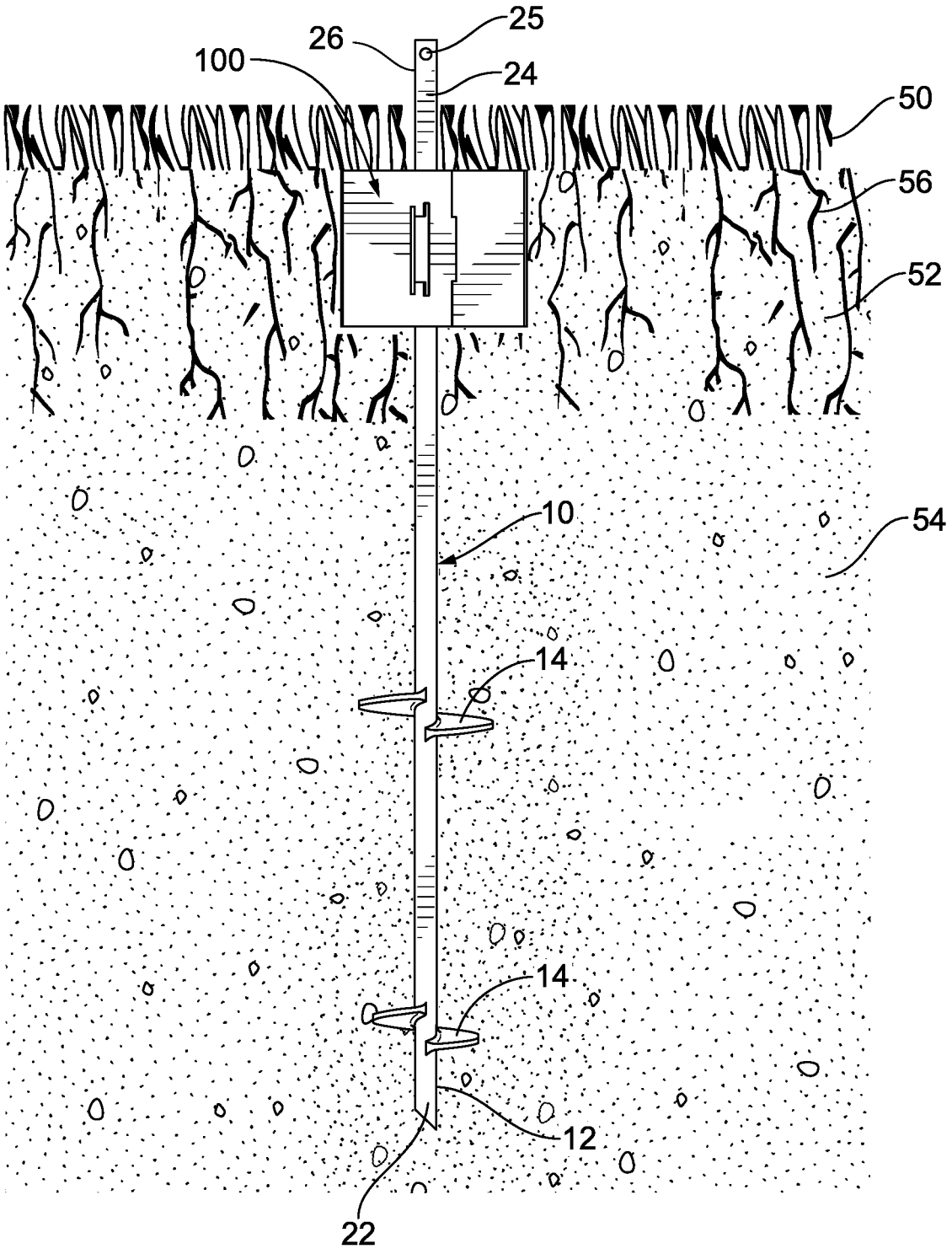
FIG. 1 is a side view of a lead shaft of helical pile including a lateral support structure according to an embodiment of the present disclosure for describing various aspects thereof.

A lead shaft 10 for helical piles including a lateral support structure 100 according to an embodiment of the present disclosure is shown in FIG. 1. Lead shaft 10 is fabricated from a shaft of steel or galvanized steel and may be hollow or solid. Lead shaft 10 includes a lead end portion 12 which may have a pointed tip 22 and includes one or more helical plates 14 mounted thereto. Lead shaft 10 includes a lead head portion 24 which may include a connector section 26 for connecting extension shafts (not shown) for achieving a desired depth. Generally, extension shafts are attached using nuts and bolts fabricated from steel, galvanized steel, etc. The lead shafts and extension shafts disclosed herein can be used as helical piles or anchors, and are capable of withstanding compression loads and tension loads. Reference herein to lead, helical lead, helical extension and helical pile also include helical anchors. Helical plates 14 may be fabricated from steel or galvanized steel and may be welded to or otherwise attached to the lead shaft 10. Extension shafts described herein may be fabricated as straight square or round shafts, hollow or solid.

When lead shaft 10 is rotated, helical plates 14 screw the pile into the earth with minimal disruption to the surrounding soil. It will be appreciated that the earth into which the pile is driven may include several different types of earth stratum. For example, as shown in FIG. 1, the earth may include a first layer of material 52 consisting of dirt, sand, clay, etc. and which may include grass 50 or other growth having roots 56 extending therein. Because of its composition and because of root growth, this layer tends to remain fairly soft, loose and movable. One or more lower layers of material 54 may generally include a more rocky mixture of materials which tends to be harder and firmer. It will be appreciated that although the lead end portion 20 may be secure in these lower layers of material 54, the first layer of material 52 may provide little if any lateral support to the lead head portion 24 as well as other portions of the pile. A lateral support structure 100 according to an embodiment of the present disclosure is provided at lead head portion 24 and provides lateral support to the pile at a position where little or none would otherwise be provided.

Figure 2:
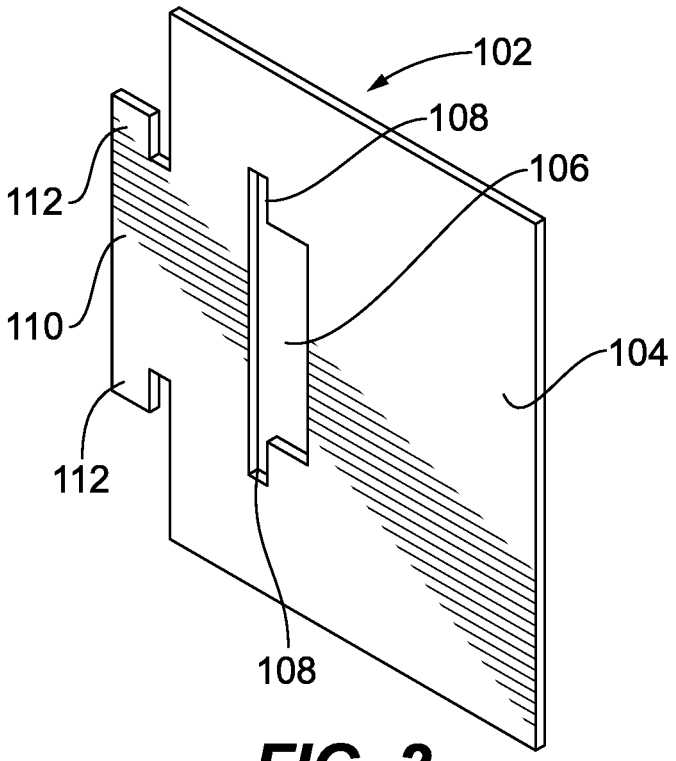
FIG. 2 is perspective view of a plate used to form the lateral support structure according to an embodiment of the present disclosure.
Figure 3:
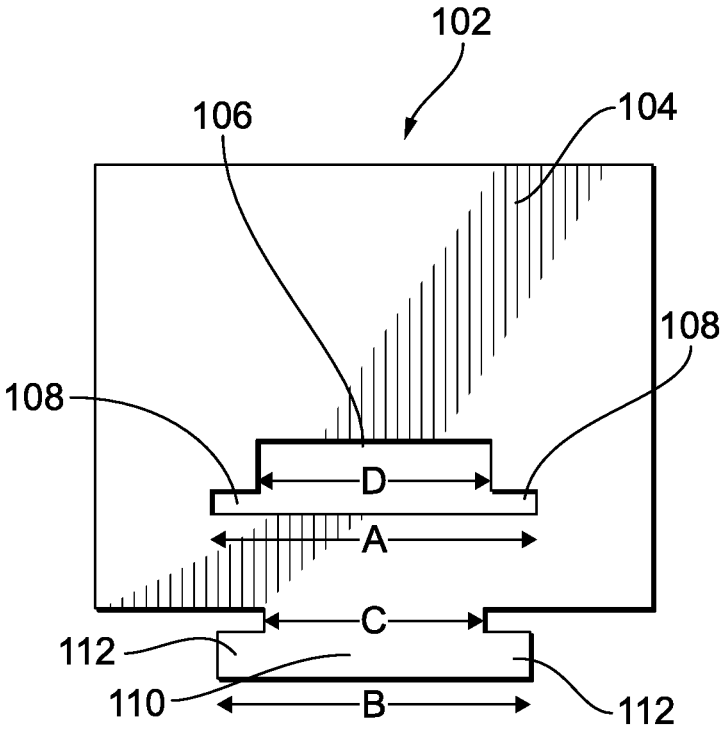
FIG. 3 is a plan view of the plate used to form the lateral support structure according to an embodiment of the present disclosure.

A lateral support structure 100 according to an illustrative embodiment of the present disclosure is formed from several plates 102 which are capable of being interlocked as will be described by reference to FIGS. 2-5. As shown in FIGS. 2 and 3, each plate 102 includes a generally rectangular or square body 104. It will be appreciated that body 104 may take other shapes without departing from the spirit and scope of the present disclosure. Plates 102 may be fabricated, for example, from steel or galvanized steel. Plate 102 includes an orifice extending there through having a generally rectangular portion 106 and notched portions 108 extending therefrom. Plate 102 also includes a tab portion 110 having ears 112 extending therefrom as shown. Referring to FIG. 3, the notched portions 108 form an opening having a width A. The tab portion 110 including ears 112 has a width B, where width A is slightly larger than width B. The rectangular portion 106 of the orifice has a width D. The neck portion of tab 110 has a width C, where width D is slightly larger than width C. These dimensions allow the tab 110 of one plate 102 to be inserted and locked in the orifice 106 of another plate 102.

Figure 4:
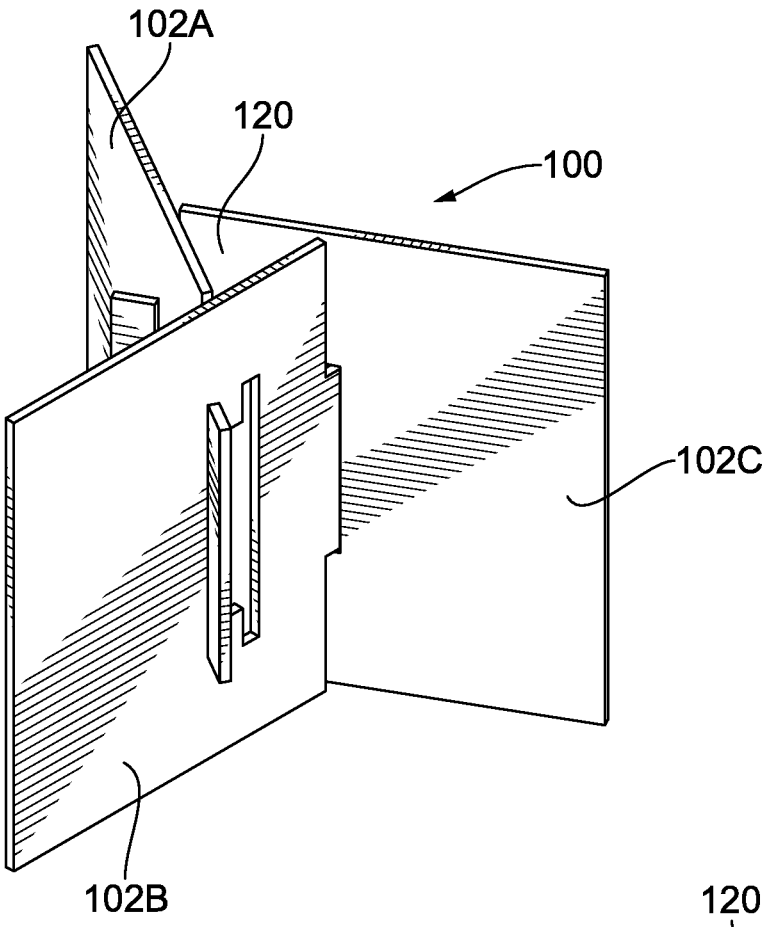
FIGS. 4 and 5 are perspective views of the assembled lateral support structure according to an illustrative embodiment of the present disclosure.
Figure 5:
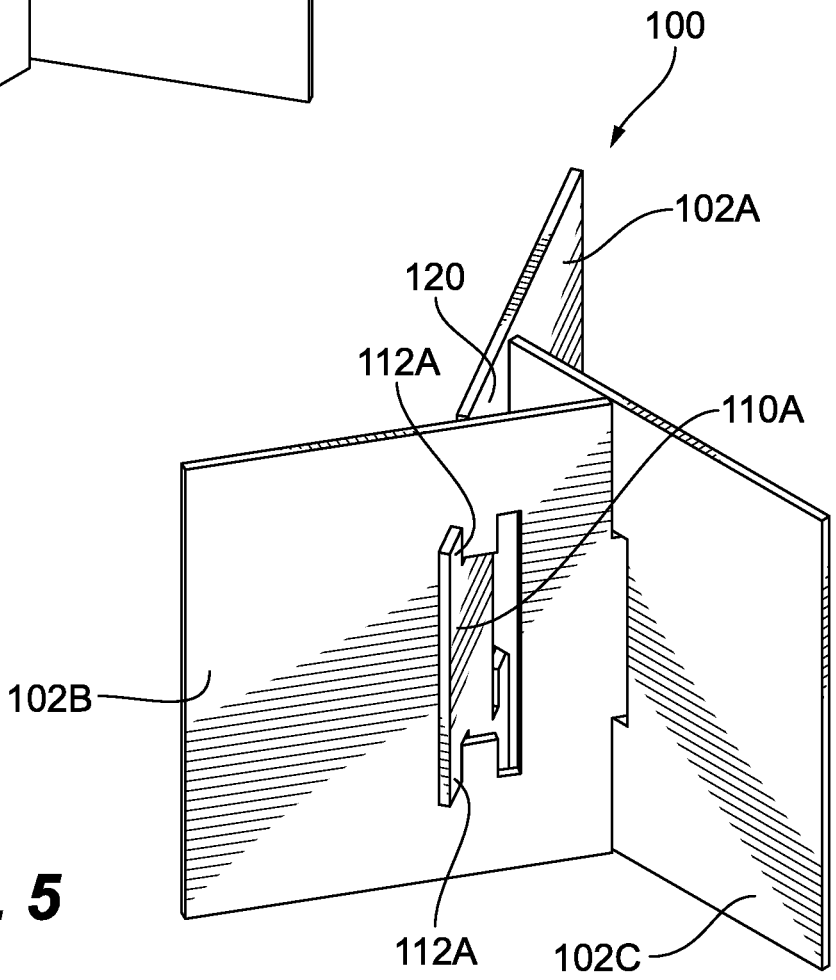

As shown in FIGS. 4 and 5, plates 102 interlock using the orifices and tabs. According to this illustrative embodiment of the present disclosure, three plates 102A, 102B and 102C are interlocked to form lateral support structure 100. For example, the tab 110A of plate 102A is inserted through the orifice in plate 102B, such that ears 112A abut against plate 102B. In a similar manner, the tab of plate 102B is inserted through the orifice in plate 102C and the tab of plate 102C is inserted through the orifice in plate 102A and form lateral support structure 100. The interlocking plates form a substantially triangular center portion 120 as shown.

Figure 6:
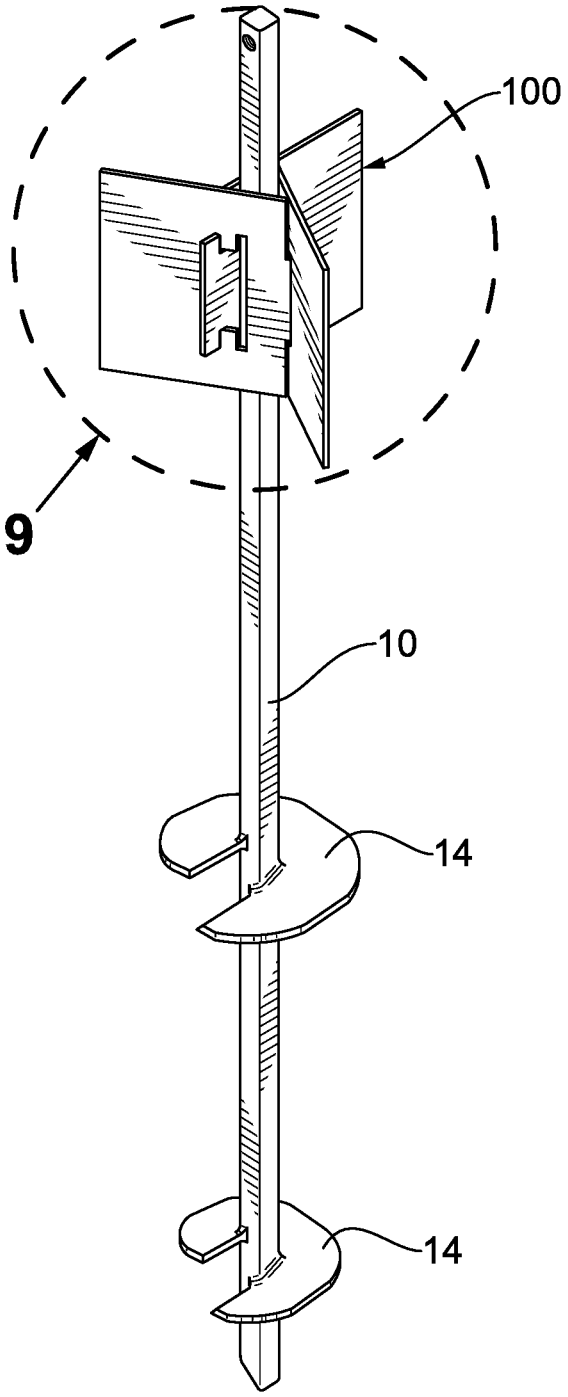
FIG. 6 is a perspective view of an assembled lateral support structure according to an embodiment of the present disclosure on a lead shaft of a helical pile.
Figure 7:
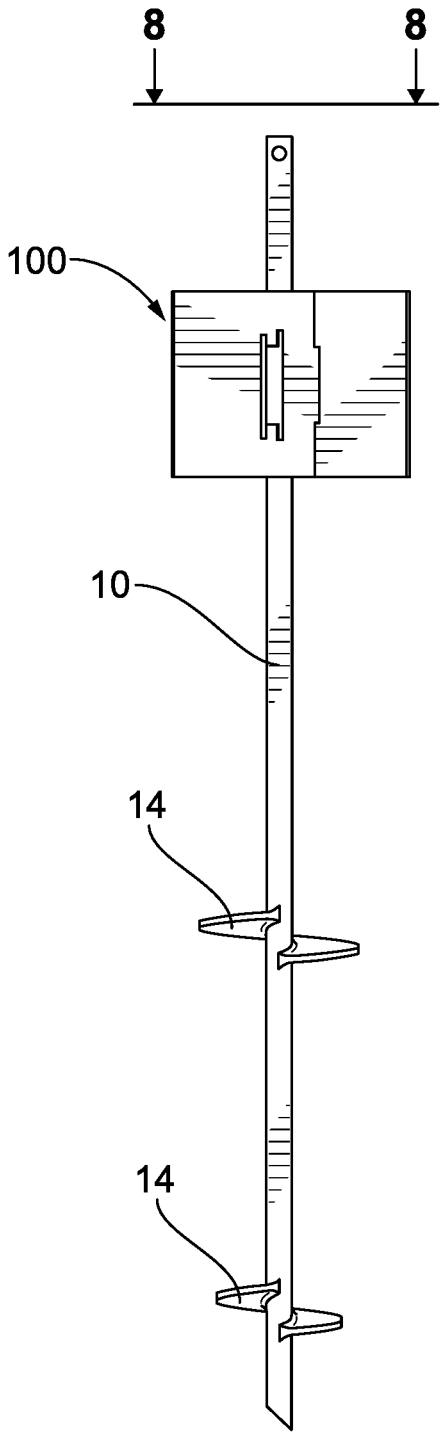
FIG. 7 is a side view of the assembled lateral support structure according to an embodiment of the present disclosure on a lead shaft of a helical pile.
Figure 8:
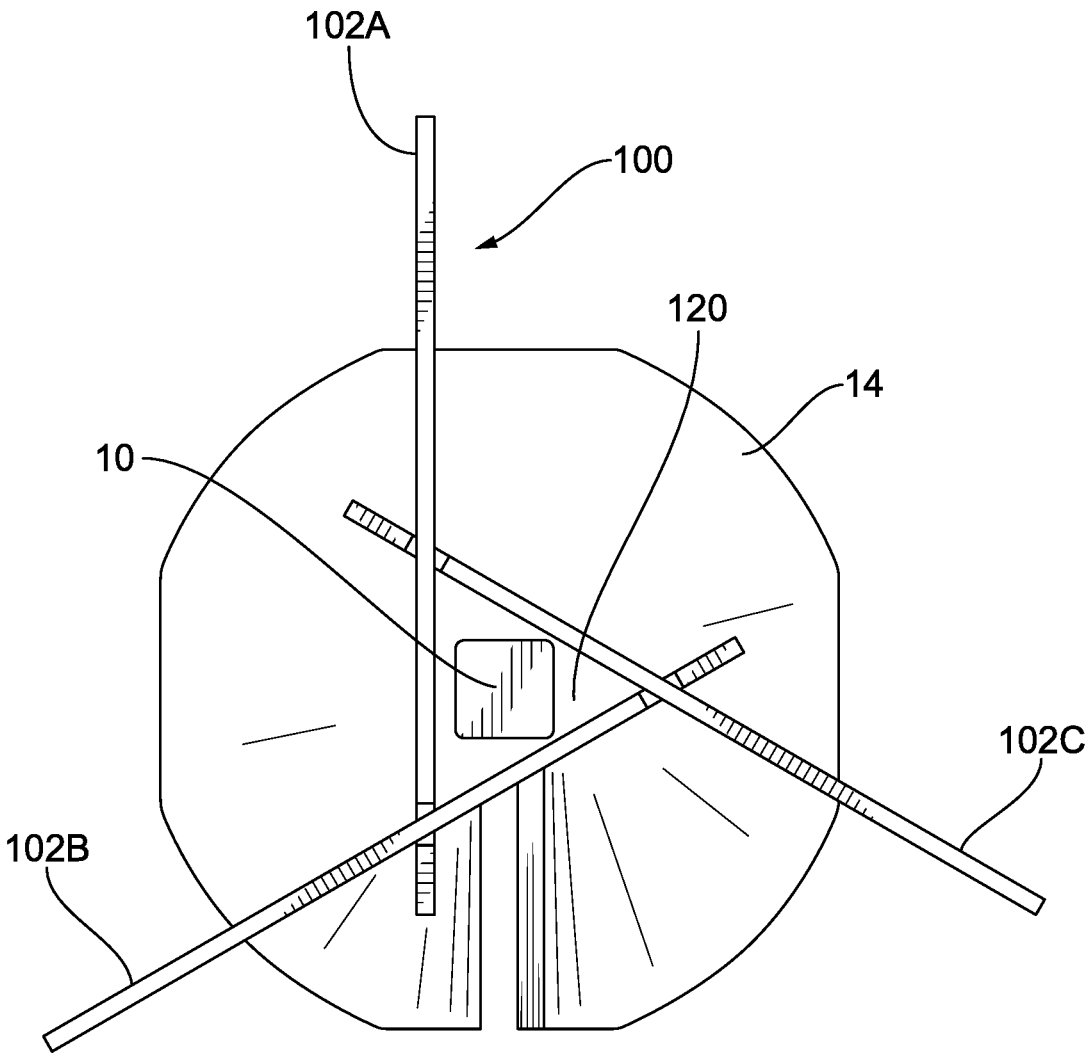
FIG. 8 is a plan view taken along lines 8 of FIG. 7.
Figure 9:
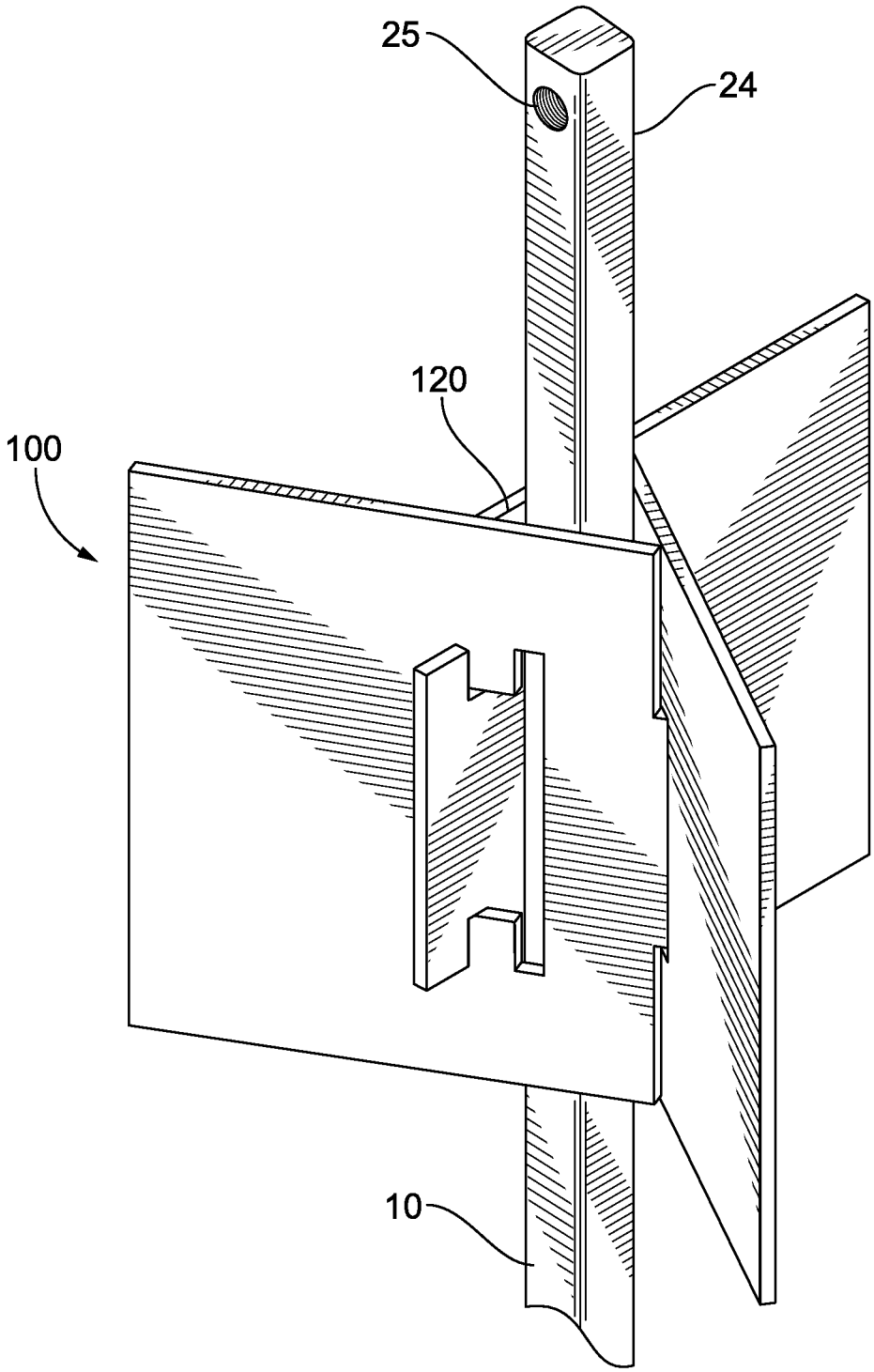
FIG. 9 is an enlarged view of the assembled lateral support structure according to an embodiment of the present disclosure on a lead shaft of a helical pile shown in FIG. 6.

A lead shaft 10 including a lateral support structure 100 according to an illustrative embodiment of the present disclosure is shown in FIGS. 6 and 7. The lateral support structure 100 is assembled from the three plates 102A-102C, as depicted in FIGS. 4 and 5, and then slid onto lead shaft 10. Once assembled and slid onto lead shaft 10, lateral support structure 100 cannot be disassembled until it is removed from the lead shaft 10. As shown in more detail in FIGS. 8 and 9, the plates 102A-102C are dimensioned such that center portion 120 is capable of receiving the lead shaft 10 and such that lead shaft 10 is capable or rotating while lateral support structure 100 remains stationary. The lead head portion 24 of shaft 10 may include an orifice 25 for receiving a screw or bolt for attaching an extension shaft to lead shaft 10 (FIG. 9).

Figure 10:
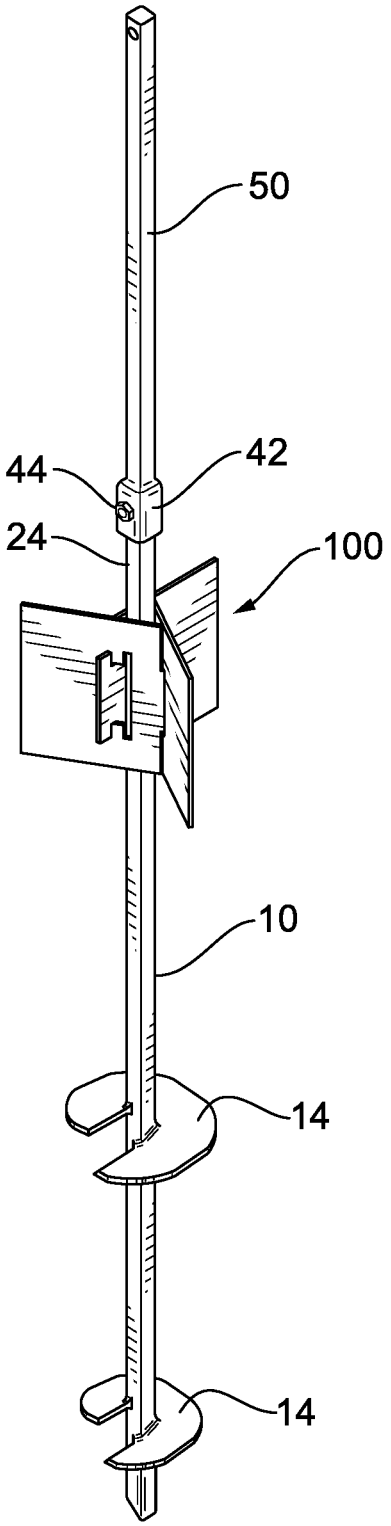
FIG. 10 is a perspective view of the assembled lateral support structure according to an embodiment of the present disclosure on a lead shaft of a helical pile and with an extension shaft attached.
Figure 11:
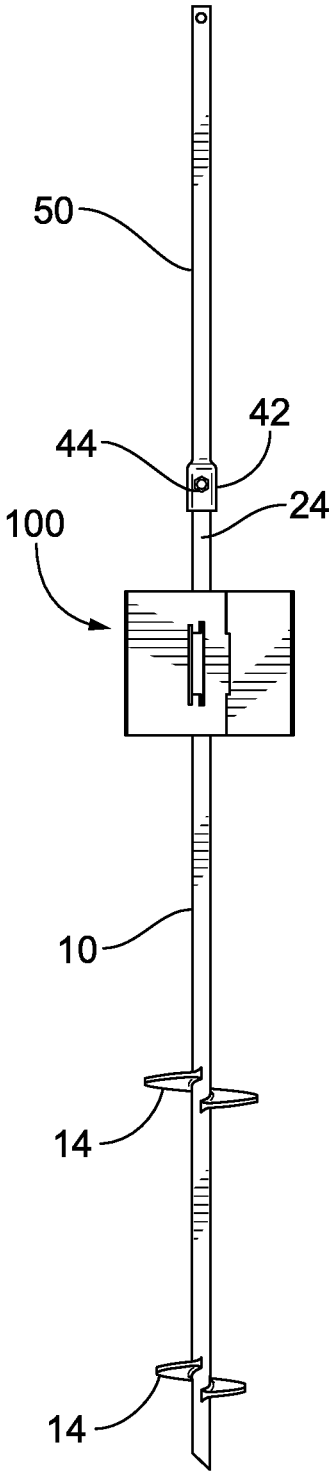
FIG. 11 is a side view of the assembled lateral support structure according to an embodiment of the present disclosure on a lead shaft of a helical pile and with an extension shaft attached.
Figure 12:
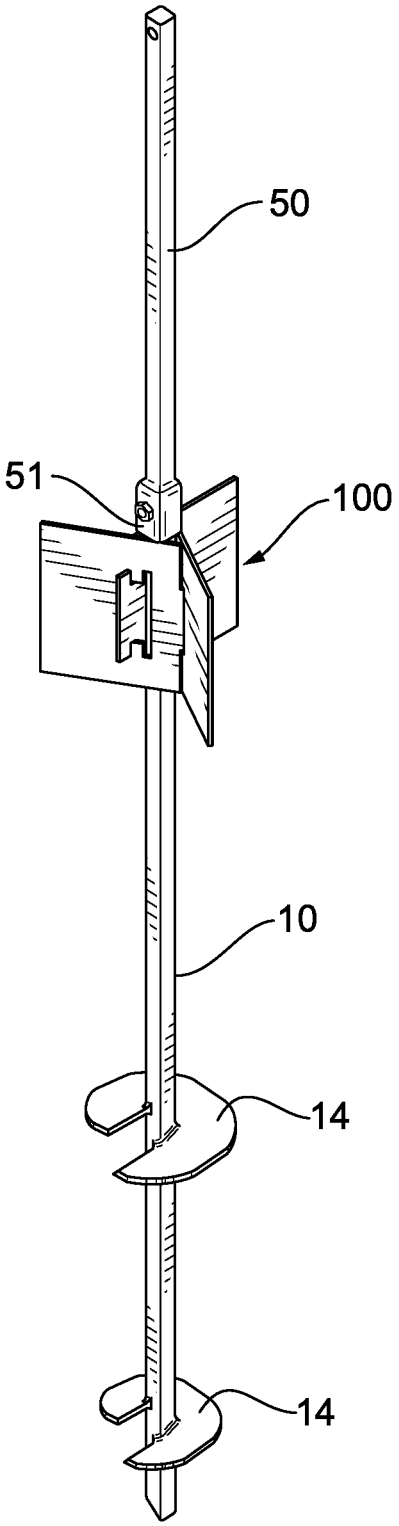
FIG. 12 is a perspective view of the assembled lateral support structure according to an embodiment of the present disclosure on a lead shaft of a helical pile and with an extension shaft attached.
Figure 13:
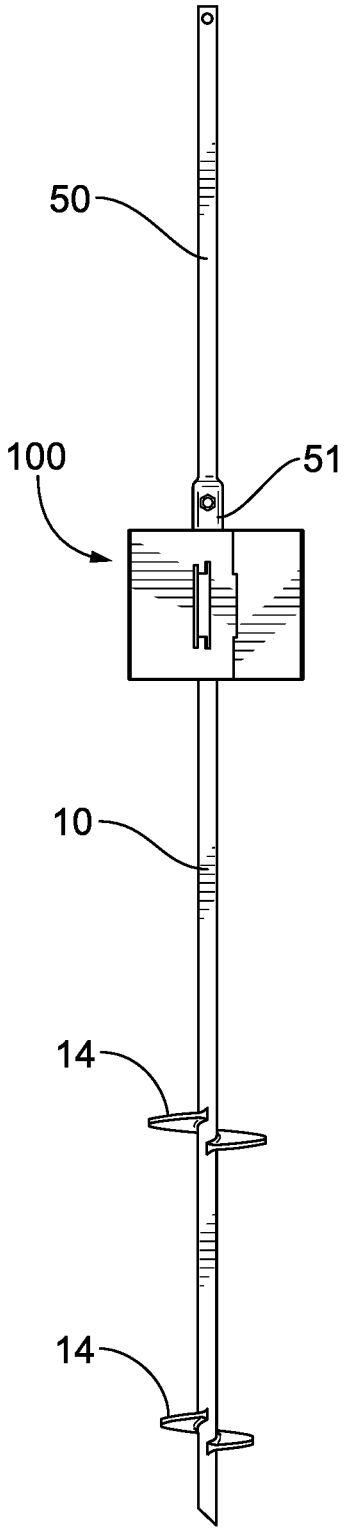
FIG. 13 is a side view of the assembled lateral support structure according to an embodiment of the present disclosure on a lead shaft of a helical pile and with an extension shaft attached.

A lead shaft 10 including a lateral support structure 100 according to an illustrative embodiment of the present disclosure is shown in FIGS. 10 and 11 and includes an extension shaft 50 mounted thereto. Extension shaft 50 includes a distal end 42 having an opening dimensioned for receiving the lead head end 24 of lead shaft 10. Distal end 42 of extension shaft 50 includes an orifice extending there through corresponding to orifice 25 in lead shaft 10 (FIG. 9) so that a locking bolt 44 can be passed through extension shaft 50 and lead shaft 10 locking the parts together with a locking nut (not shown). As extension shaft 50 and lead shaft 10 are rotated, helical plates 14 draw lead 10 down into the ground. Referring to FIGS. 12 and 13, when lateral support structure 100 makes contact with the ground, lateral support structure 100 slides up lead shaft 10 until it abuts the union 51 between lead shaft 10 and extension shaft 50. As extension shaft 50 and lead shaft 10 are further rotated, lateral support structure 100 is driven into the ground to a desired depth.

Figure 14:
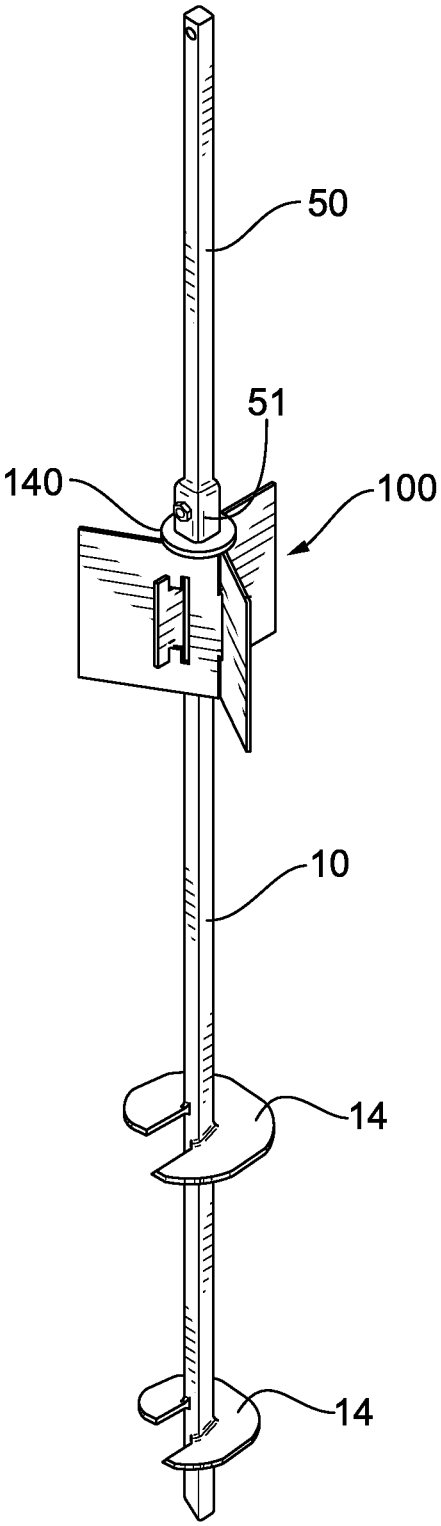
FIG. 14 is a perspective view of the assembled lateral support structure according to an embodiment of the present disclosure on a lead shaft of a helical pile and with an extension shaft attached and utilizing a washer plate.
Figure 15:
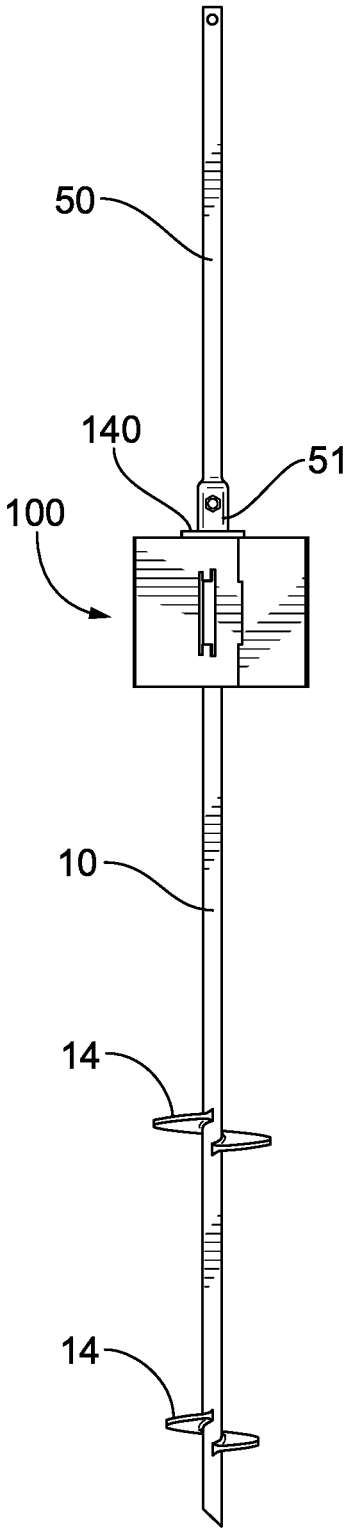
FIG. 15 is a side view of the assembled lateral support structure according to an embodiment of the present disclosure on a lead shaft of a helical pile and with an extension shaft attached and utilizing a washer plate.

A lead shaft 10 including a lateral support structure 100 according to an illustrative embodiment of the present disclosure is shown in FIGS. 14 and 15 and includes an extension shaft 50 mounted thereto. According to this embodiment, a washer plate 140 is provided between union 51 and lateral support structure 100. Washer plate 140 has an inner opening diameter dimensioned to receive lead shaft 10 and such that washer plate 140 abuts union 51. Washer plate 140 has an outer diameter that is larger than the center portion 120 (FIG. 8) of the lateral support structure 100. The use of washer plate 140 allows the lateral support structure 100 to be utilized in situations where the union 51 is small enough such that it would otherwise fit within center portion 120 of lateral support structure 100.

Figure 16:
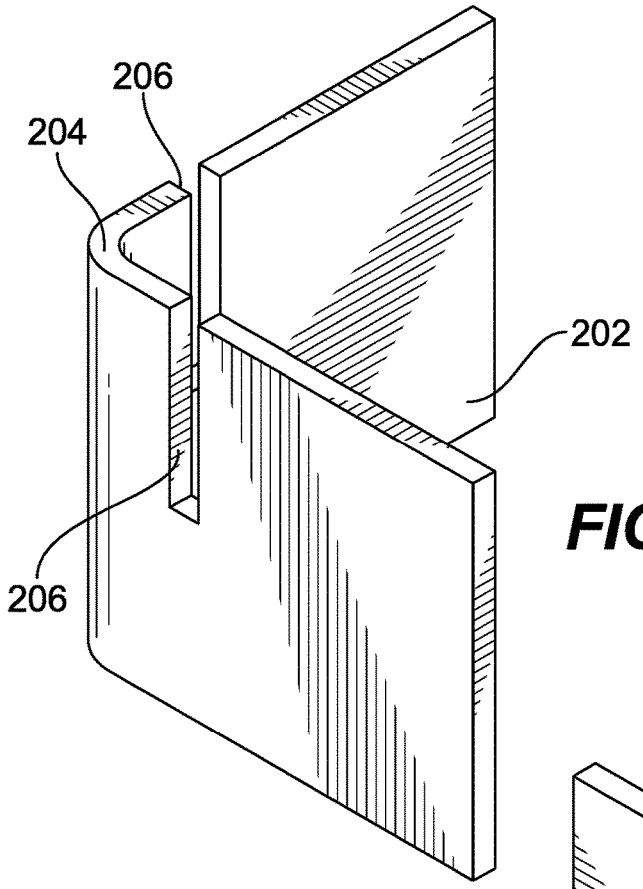
FIG. 16 is a perspective view of a portion of a lateral support structure according to an embodiment of the present disclosure.
Figure 17:
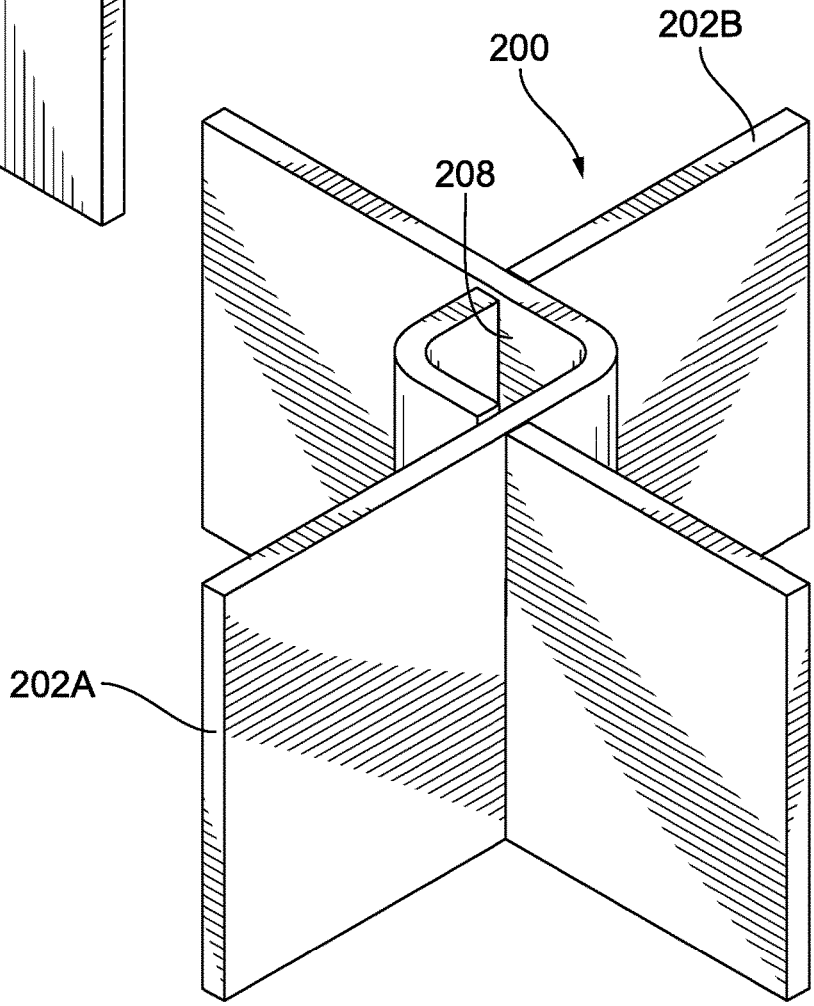
FIG. 17 is perspective view of an assembled lateral support structure according to an embodiment of the present disclosure.
Figure 18:
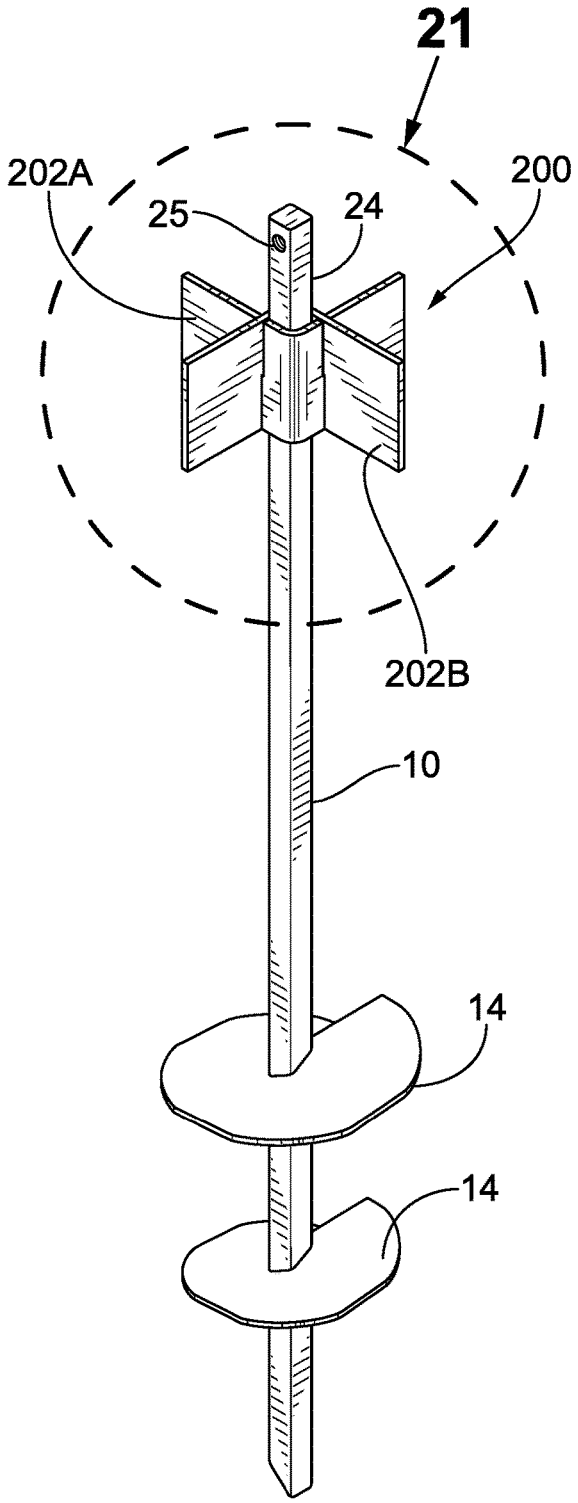
FIG. 18 is a perspective view of an assembled lateral support structure according to an embodiment of the present disclosure on a lead shaft of a helical pile.
Figure 19:
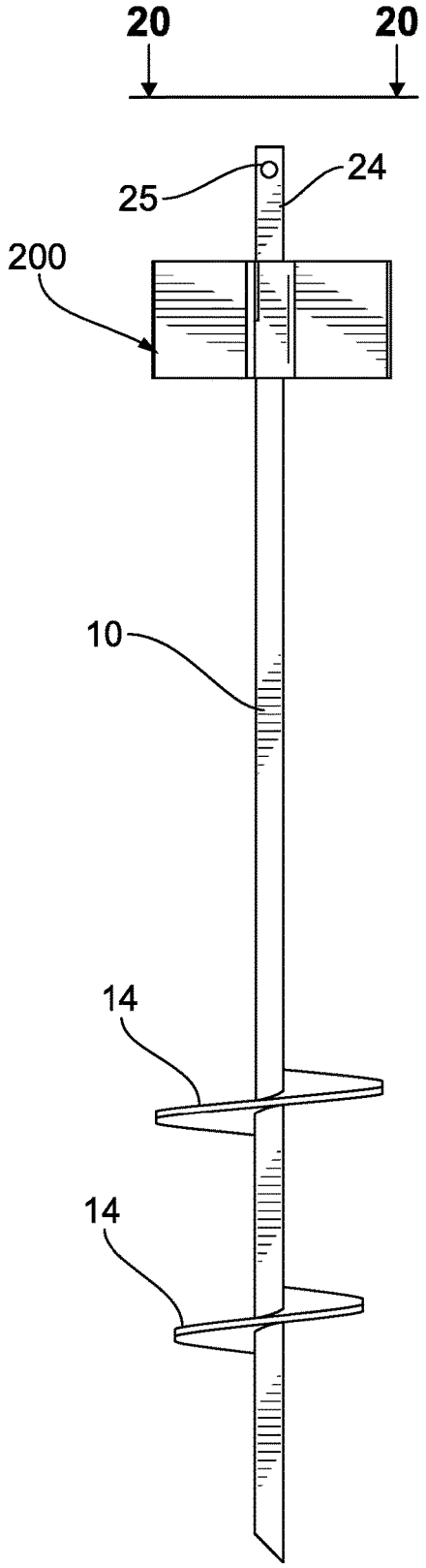
FIG. 19 is a side view of the assembled lateral support structure according to an embodiment of the present disclosure on a lead shaft of a helical pile.

A support structure according to another illustrative embodiment of the present disclosure is shown in FIGS. 16-22 and is referred to generally as lateral support structure 200. Lateral support structure 200 according to the present illustrative embodiment is formed from two interlocking plates 202 (FIG. 16). Each plate 202 is fabricated from steel or galvanized steel that is bent at a ninety-degree angle 204 as shown. On either side of the ninety degree bend a notch 206 is cut out of the plate 202. The width of notch 206 is slightly larger than the thickness of the plate 202. Each notch 206 extends approximately half way across the width of plate 202. Lateral support structure 200 is formed by aligning the notches of plate 202A with the notches of plate 202B and sliding the two plates 202A and 202B together to form the lateral support structure 200 as shown in FIG. 17. Lateral support structure 200 forms a center portion 208 dimensioned for receiving a shaft of a helical pile and such that the shaft is capable of rotating within the center portion 208 (e.g., see FIG. 20).

Figure 20:
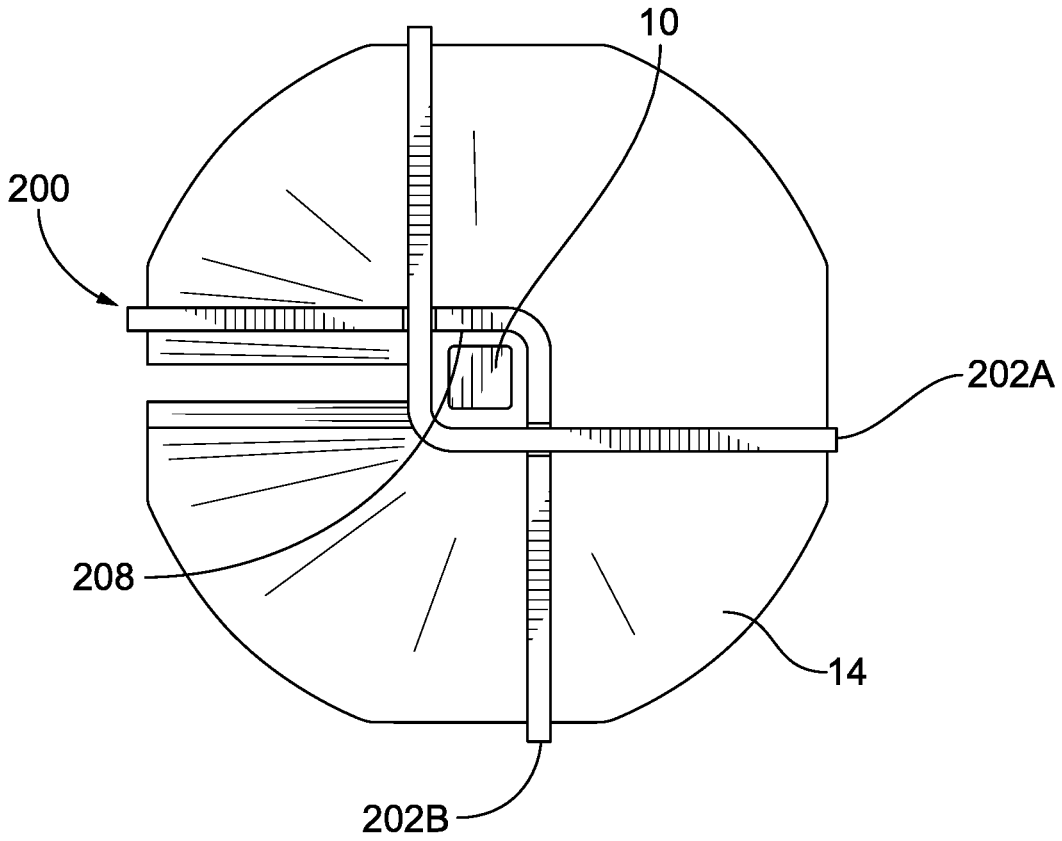
FIG. 20 is a plan view taken along lines 20 of FIG. 19.
Figure 21:
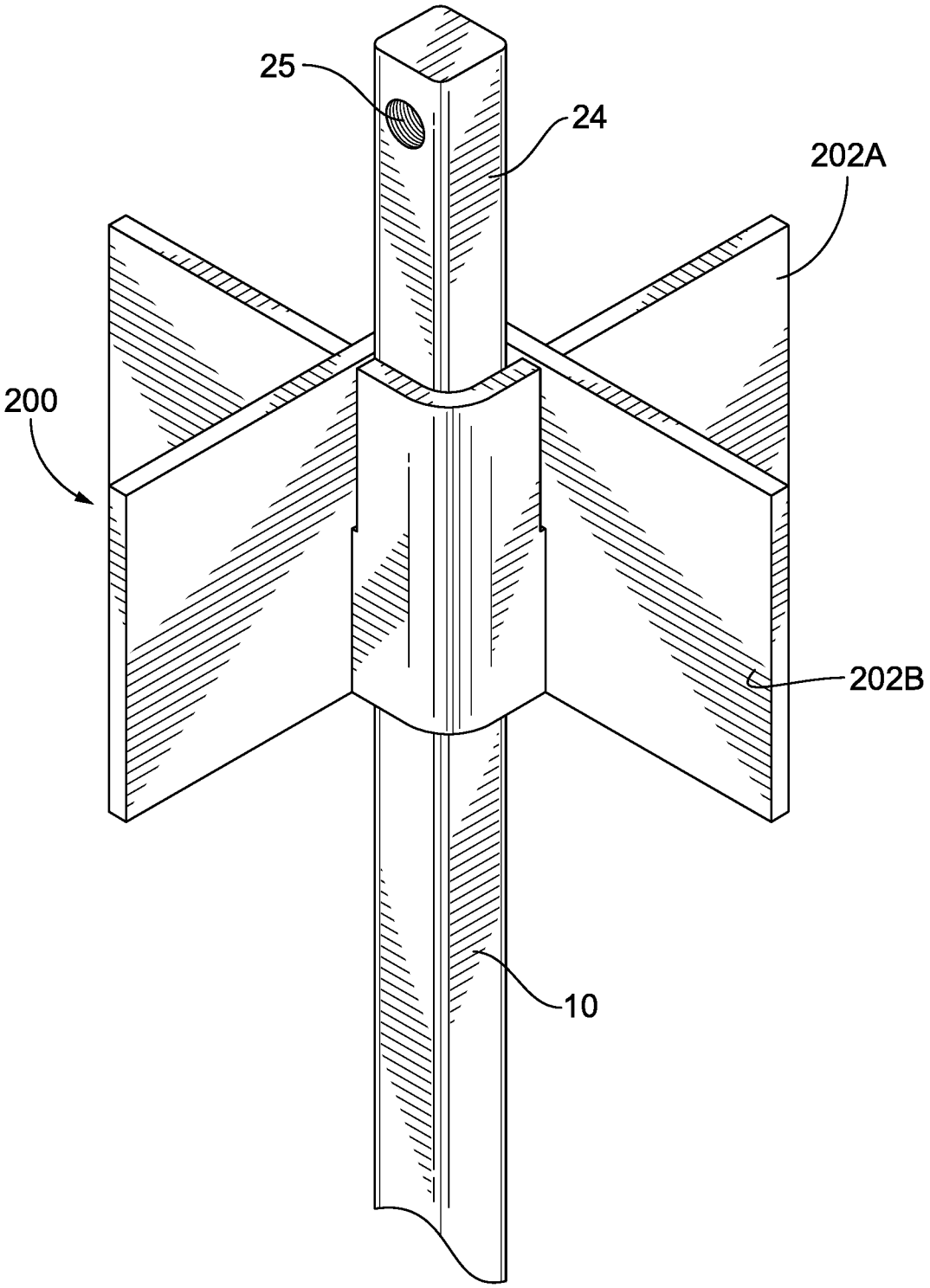
FIG. 21 is an enlarged view of the assembled lateral support structure according to an embodiment of the present disclosure on a lead shaft of a helical pile shown in FIG. 18.

A lead shaft 10 including a lateral support structure 200 according to an illustrative embodiment of the present disclosure is shown in FIGS. 18-22. Lateral support structure 200 may be assembled on lead shaft 10 or may be assembled and then slid onto lead shaft 10, depending on the particular application. For example, as shown in more detail in FIGS. 20 and 21, lead shaft 10 includes lead head portion 24 that is the same dimension as the rest of the lead shaft 10. Accordingly, in this case, lateral support structure 200 can be assembled and then slid onto lead shaft 10. Lead head portion 24 includes an orifice 25 for receiving a locking bolt for attaching an extension shaft. As shown in FIG. 20, center portion 208 of lateral support structure 200 is dimensioned to receive lead shaft 10 such that lead shaft 10 is capable of rotating within center portion 208. Referring to FIG. 21, a lead head portion 24 of lead shaft 10 may include an orifice 25 used for attaching an extension shaft as described herein with respect to other embodiments.

Figure 22:
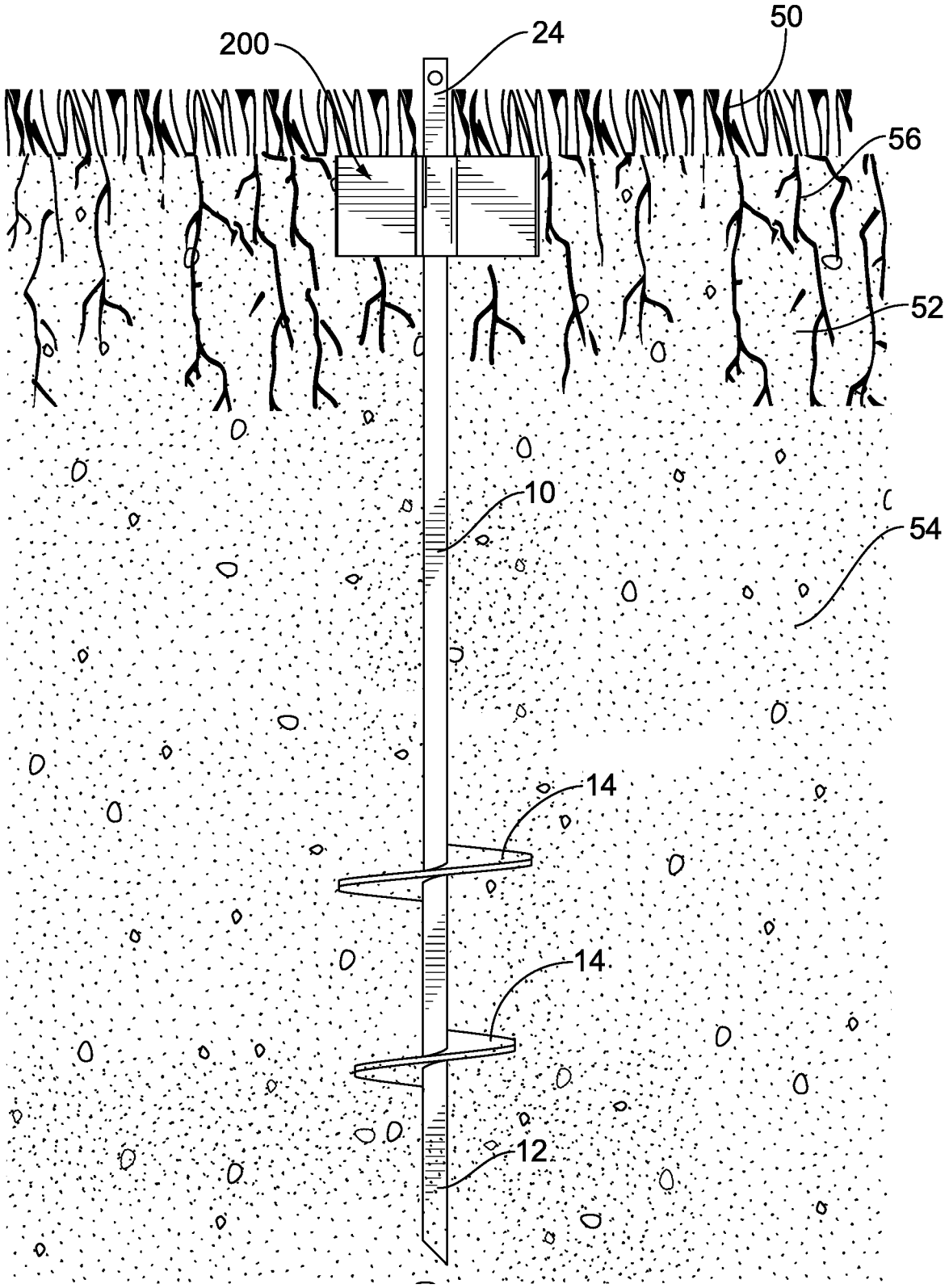
FIG. 22 is a side view of a lead for helical pile including a lateral support structure according to an embodiment of the present disclosure for describing various aspects thereof.

Referring to FIG. 22, when lead shaft 10 is rotated, helical plates 14 screw the pile into the earth with minimal disruption to the surrounding soil. Although not shown and not necessary for a complete understanding of embodiments of the present disclosure, a pile screw drive may be provided for rotating lead shaft 10. The pile screw drive generally includes a socket end dimensioned to receive lead head portion 24. Lateral support structure 200 will abut the pile screw drive socket and be driven into the ground as lead shaft 10 is rotated. It will be appreciated that the earth into which the pile is driven may include several different types of earth stratum. For example, as shown in FIG. 22, the earth may include a first layer of material 52 consisting of dirt, sand, clay, etc. and which may include grass 50 or other growth having roots 56 extending therein. Because of its composition and because of root growth, this layer tends to remain fairly soft, loose and movable. One or more lower layers of material 54 may generally include a more rocky mixture of materials which tends to be harder and firmer. It will be appreciated that although the lead end portion 12 of lead shaft 10 may be secure in these lower layers of material 54, the first layer of material 52 may provide little if any lateral support to the lead head portion 24. A lateral support structure 200 according to an embodiment of the present disclosure is provided at lead head portion 24 and provides lateral support to the pile at a position where little or none would otherwise be provided.

A support structure according to another illustrative embodiment of the present disclosure is shown in FIGS. 23-29 and is referred to generally as lateral support structure 300. Lateral support structure 300 according to the present illustrative embodiment is formed from two interlocking plates 302A and 302B as shown in FIGS. 23A and 23B, respectively.

Figure 23A:
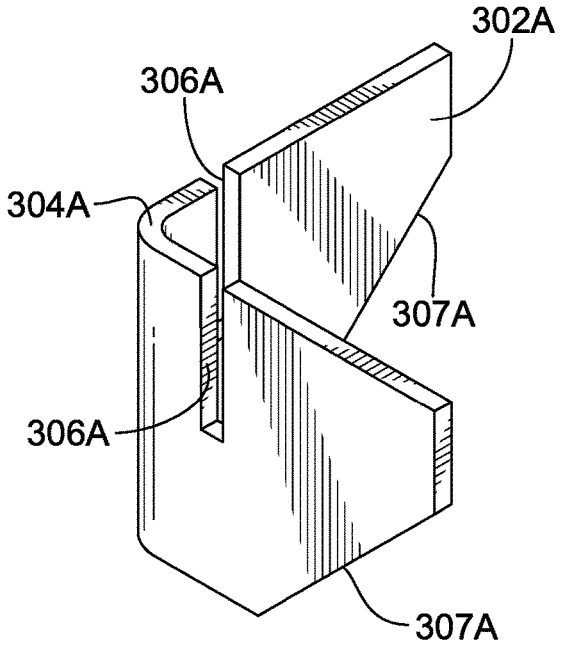
FIGS. 23A and 23B are perspective views of parts of a lateral support structure according to an illustrative embodiment of the present disclosure.

Referring to FIG. 23A, plate 302A is fabricated from a plate of steel or galvanized steel that is bent at a ninety-degree angle 304A. On either side of the ninety-degree bend, a notch 306A is cut out of the plate 302A. The width of each notch 306A is slightly larger than the thickness of the plate 302A. Each notch 306A extends approximately half way across the width of plate 302A. A section of plate 302A is removed from the corner portions opposite notches 306A, leaving diagonal corner edges 307A.

Figure 23B:
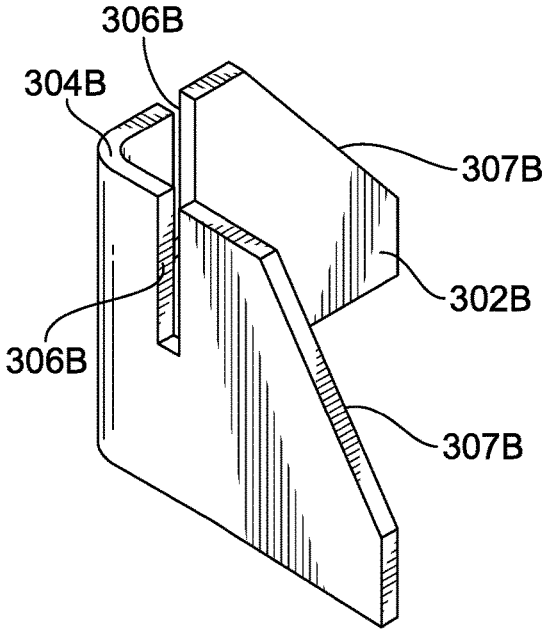

As shown in FIG. 23B, plate 302B is fabricated from a plate of steel or galvanized steel that is bent at a ninety-degree angle 304B. On either side of the ninety degree bend a notch 306B is cut out of the plate 302B. The width of each notch 306B is slightly larger than the thickness of the plate 302B. Each notch 306B extends approximately half way across the width of plate 302B. A section of plate 302B is removed from the corner portions on the same side as notches 306B, leaving diagonal corner edges 307B.

Figure 24:
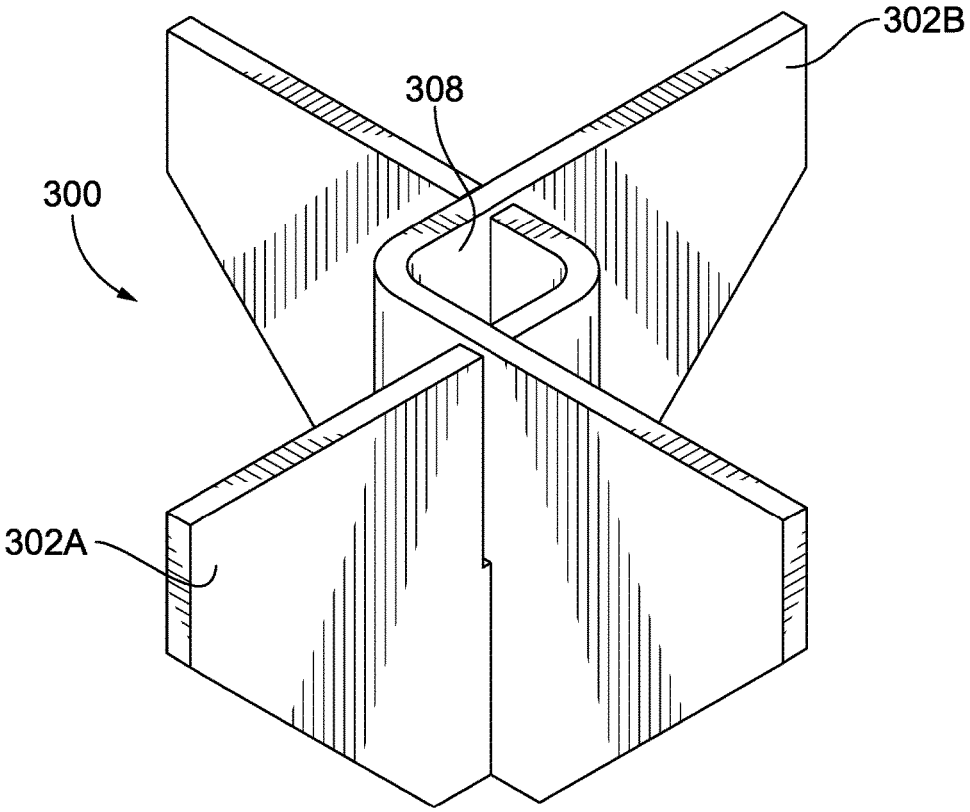
FIG. 24 is an assembled lateral support structure according to an illustrative embodiment of the present disclosure.
Figure 25:
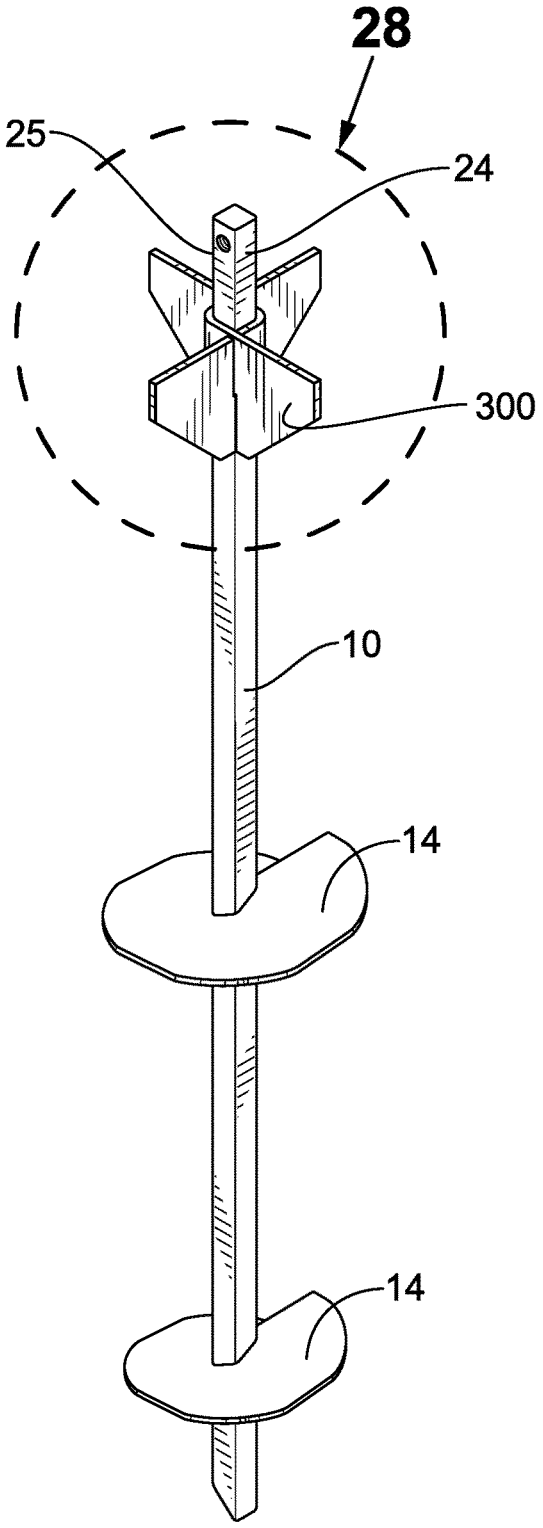
FIG. 25 is a perspective view of an assembled lateral support structure according to an embodiment of the present disclosure on a lead shaft of a helical pile.
Figure 26:
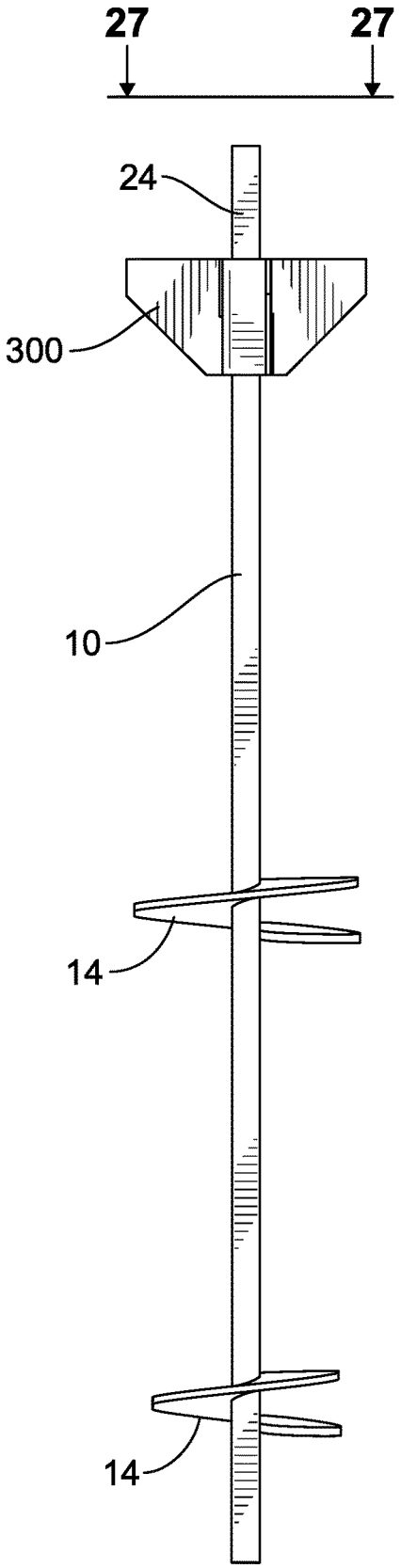
FIG. 26 is a side view of the assembled lateral support structure according to an embodiment of the present disclosure on a lead shaft of a helical pile.

Referring to FIG. 24, lateral support structure 300 is formed by aligning the notches 306A of plate 302A with the notches 306B of plate 302B and sliding the two plates 302A and 302B together to form the lateral support structure 300. Lateral support structure 300 forms a center portion 308 dimensioned for receiving a shaft of a helical pile and such that the shaft is capable of rotating within the center portion 308.

Figure 27:
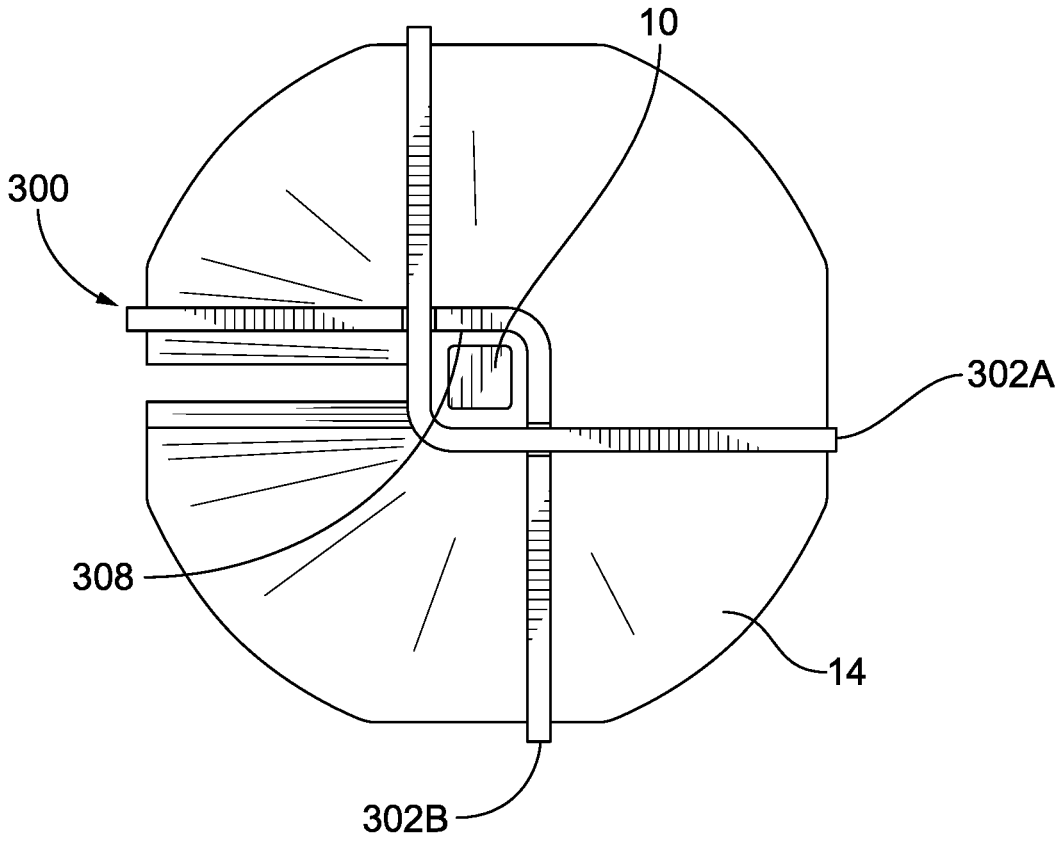
FIG. 27 is a plan view taken along lines 27 of FIG. 26.
Figure 28:
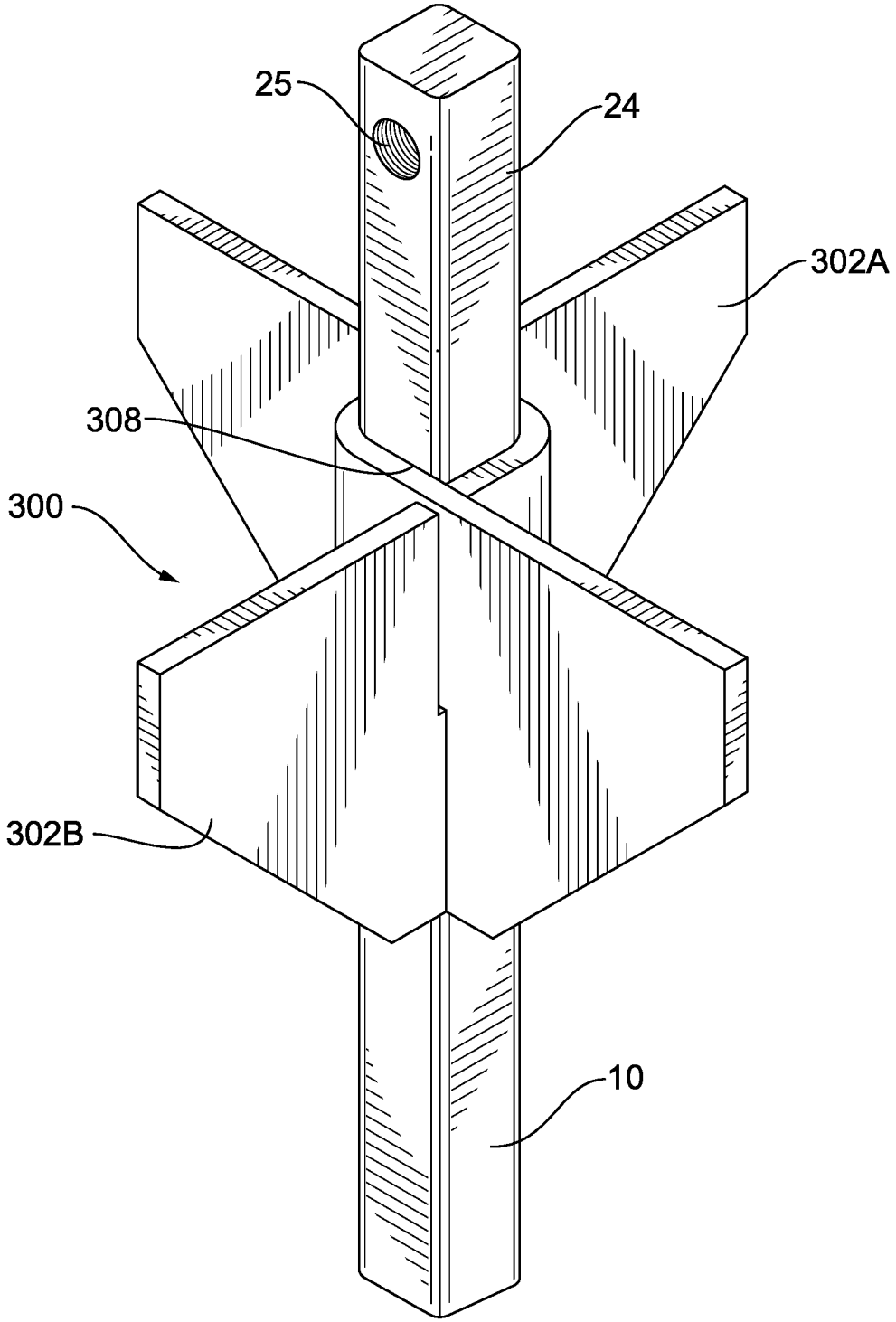
FIG. 28 is an enlarged view of the assembled lateral support structure according to an embodiment of the present disclosure on a lead shaft of a helical pile shown in FIG. 25.

A lead shaft 10 including a lateral support structure 300 according to an illustrative embodiment of the present disclosure will be described by reference to FIGS. 25-29. Lateral support structure 300 may be assembled on lead shaft 10 or may be assembled and then slid onto lead shaft 10. For example, as shown in more detail in FIGS. 25 and 28, lead shaft 10 includes lead head portion 24 that has the same dimensions as the rest of the lead shaft 10. Accordingly, in this case, lateral support structure 300 can be assembled and then slid onto lead shaft 10. Lead head portion 24 includes an orifice 25 for receiving a locking bolt for attaching an extension shaft. As shown in FIG. 27, center portion 308 of lateral support structure 300 is dimensioned to receive lead shaft 10 such that lead shaft 10 is capable of rotating within center portion 308.

Figure 29:
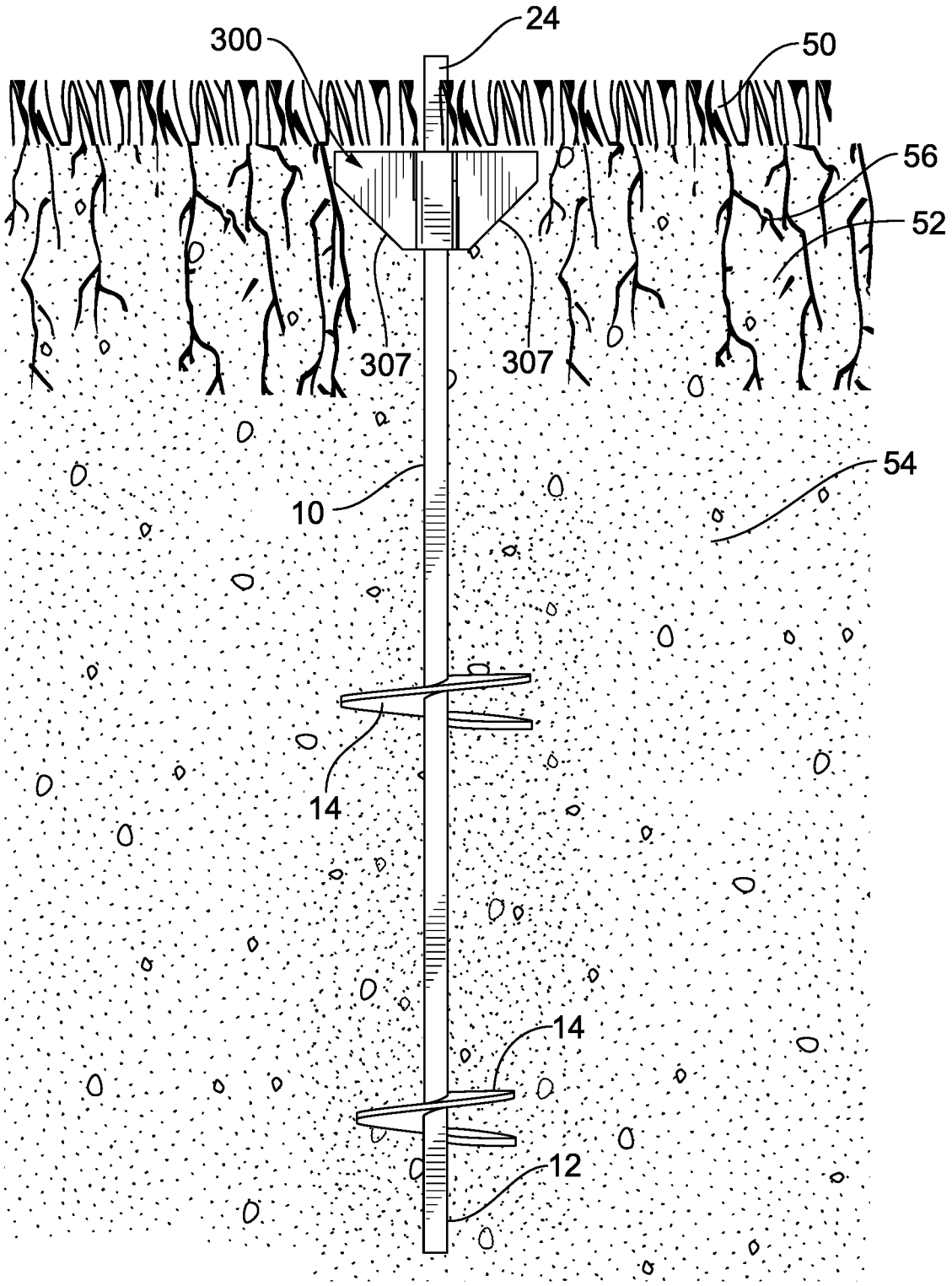
FIG. 29 is a side view of a lead for helical pile including a lateral support structure according to an embodiment of the present disclosure for describing various aspects thereof.

Referring to FIG. 29, when lead shaft 10 is rotated using a pile screw drive as described above, helical plates 14 screw the pile into the earth with minimal disruption to the surrounding soil. The diagonal corner edges 307 of lateral support structure 300 allow the lateral support structure 300 to be driven into the ground easier than would otherwise be possible. It will be appreciated that the earth into which the pile is driven may include several different types of earth stratum. For example, as shown in FIG. 29, the earth may include a first layer of material 52 consisting of dirt, sand, clay, etc. and which may include grass 50 or other growth having roots 56 extending therein. Because of its composition and because of root growth, this layer tends to remain fairly soft, loose and movable. One or more lower layers of material 54 may generally include a more rocky mixture of materials which tends to be harder and firmer. It will be appreciated that although the lead end portion 12 may be secure in these lower layers of material 54, the first layer of material 52 may provide little if any lateral support to the lead head portion 24. A lateral support structure 300 according to an embodiment of the present disclosure is provided at lead head portion 24 and provides lateral support to the pile at a position where little or none would otherwise be provided.

Figure 30:
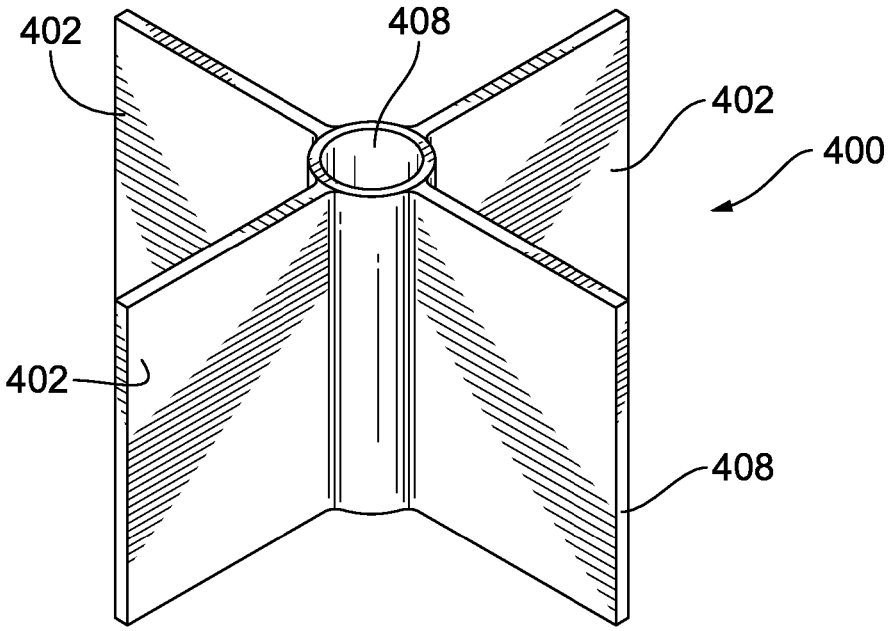
FIGS. 30 and 31 are perspective views of a lateral support structure according to an embodiment of the present disclosure.
Figure 31:
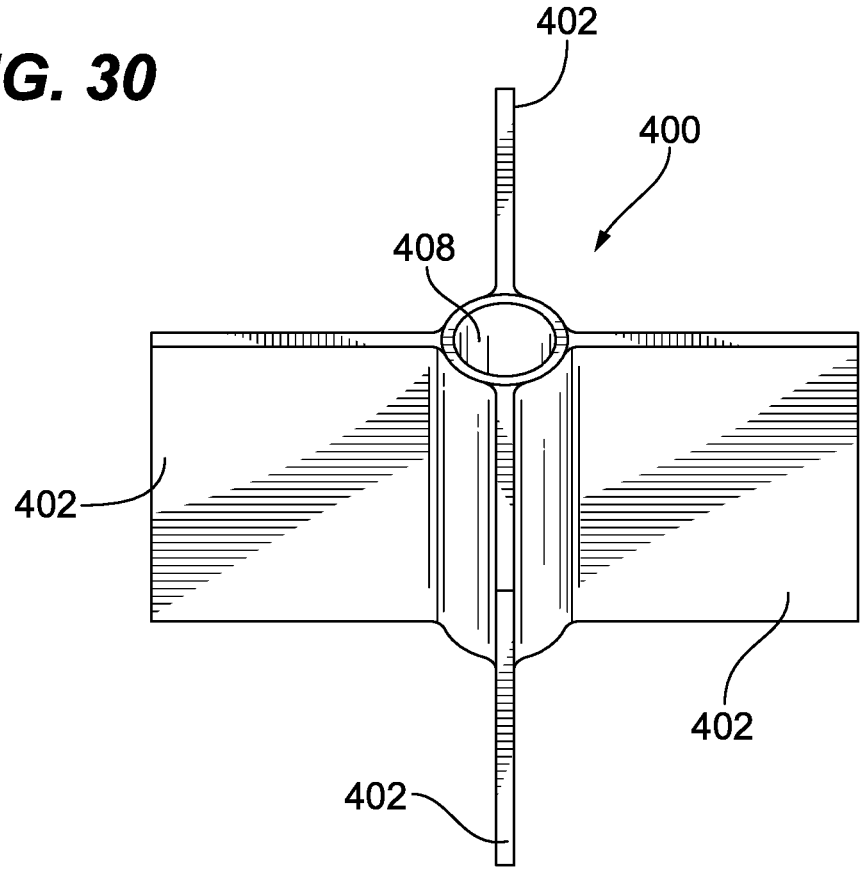
Figure 32:
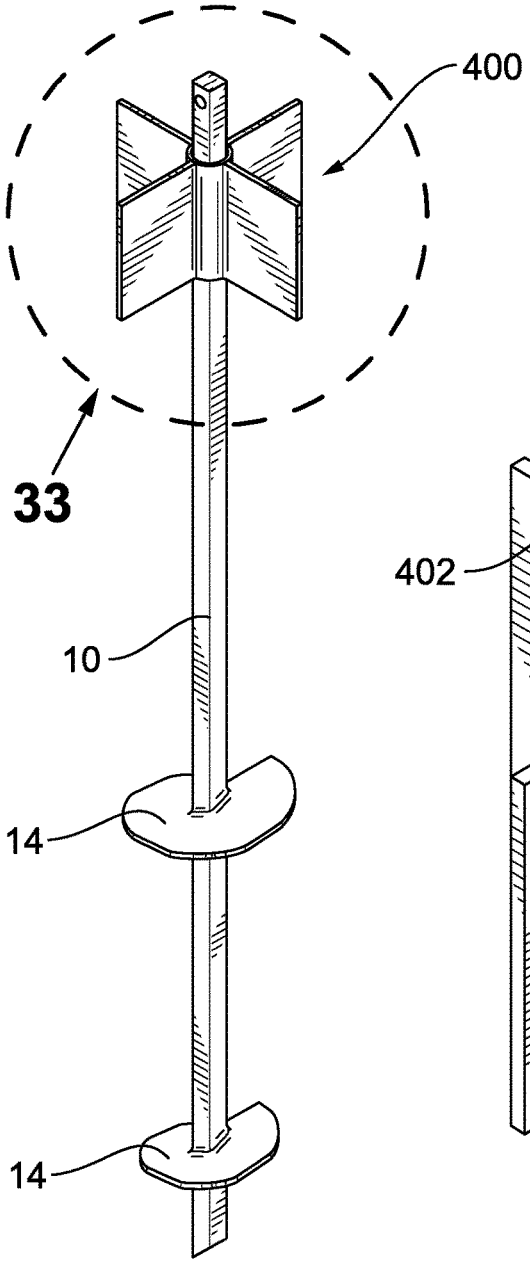
FIG. 32 is a perspective view of a lateral support structure according to an embodiment of the present disclosure on a lead for a helical pile.
Figure 33:
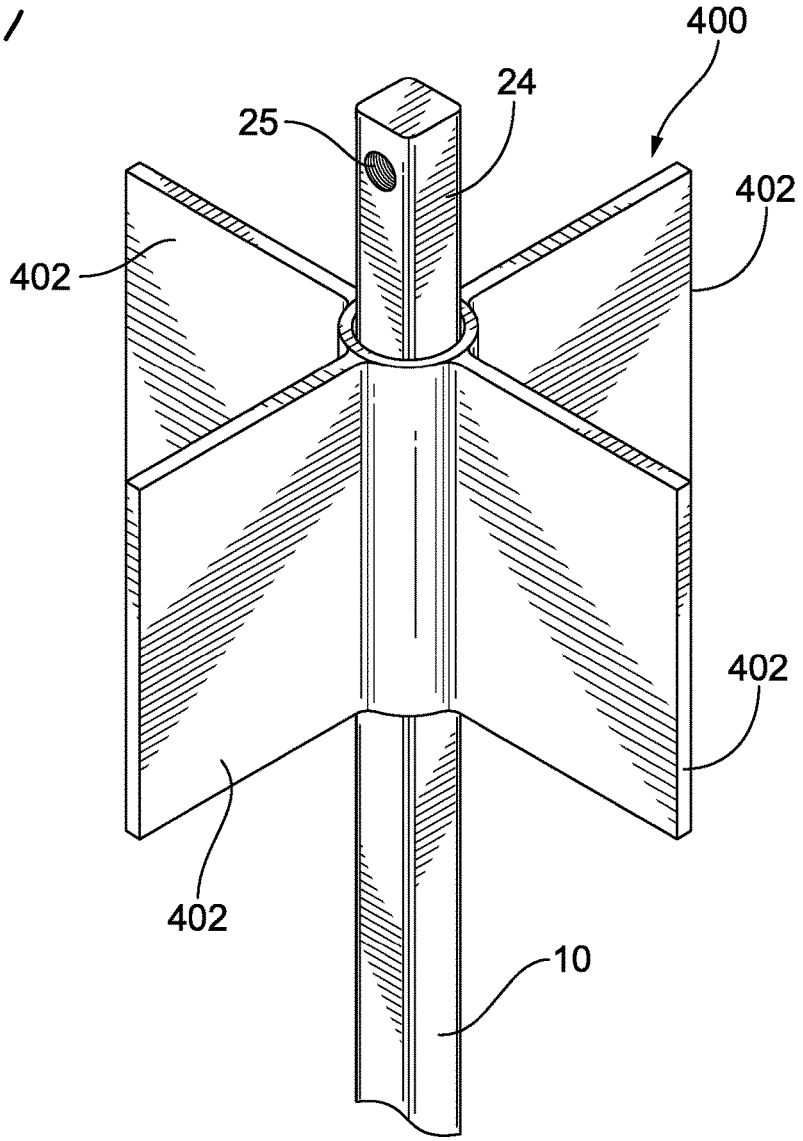
FIG. 33 is an enlarged view of a lateral support structure according to an embodiment of the present disclosure on a lead shaft of a helical pile shown in FIG. 32.

A lateral support structure 400 according to another illustrative embodiment of the present disclosure is shown in FIGS. 30 and 31. Lateral support structure 400 may be fabricated from steel or galvanized steel. Lateral support structure 400 includes a center tube 408 dimensioned for receiving a shaft of a helical pile. Center tube 408 may be round, square, triangular or any other shape suitable for the particular shaft to which lateral support structure 400 is to be used. Center tube 408 is dimensioned to receive the shaft such that the shaft is rotatable therein. A plurality of fins 402 are welded to or otherwise extend from center tube 408. Fins 402 may be shaped other than as shown. For example, the lower corners of the fins 402 may be removed such that the fins 402 are shaped as in the previous embodiment (e.g., FIGS. 23-29).

Figure 34:
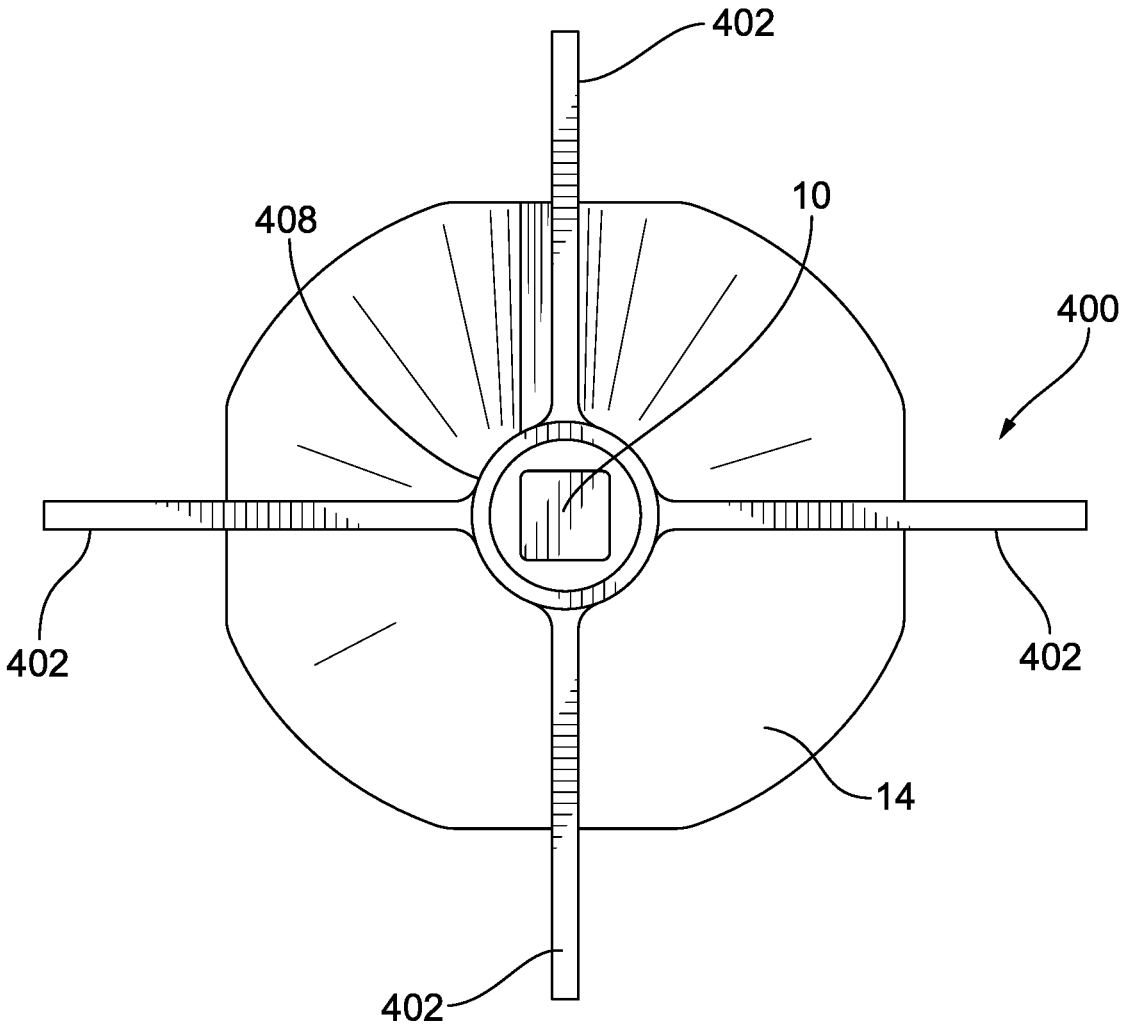
FIG. 34 is a top plan view of a lateral support structure according to an embodiment of the present disclosure.
Figure 35:
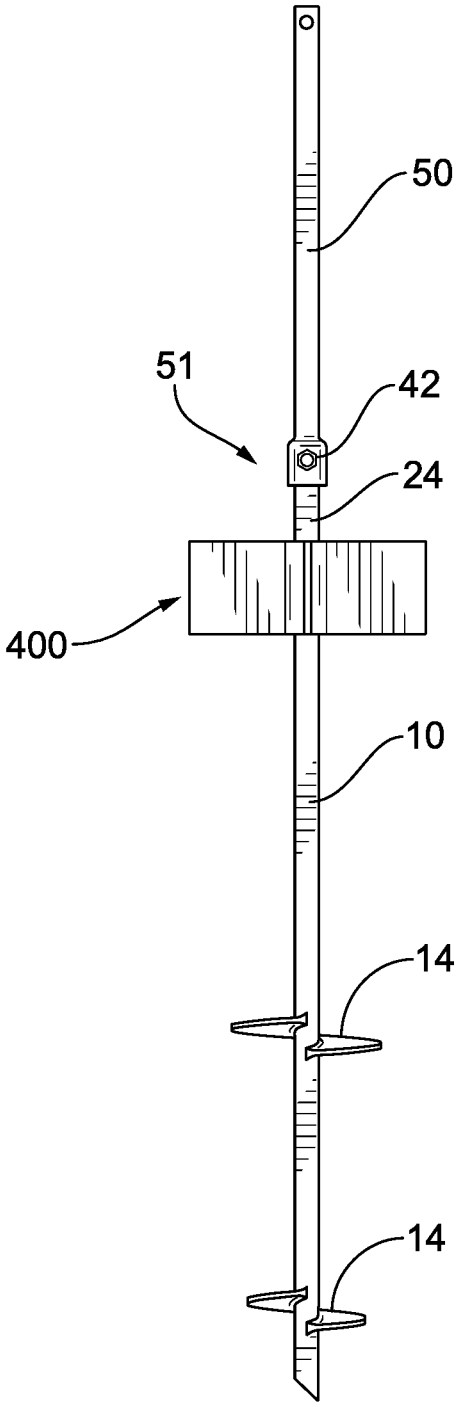
FIG. 35 is a side view of the lateral support structure according to an embodiment of the present disclosure on a lead shaft of a helical pile and with an extension shaft attached.
Figure 36:
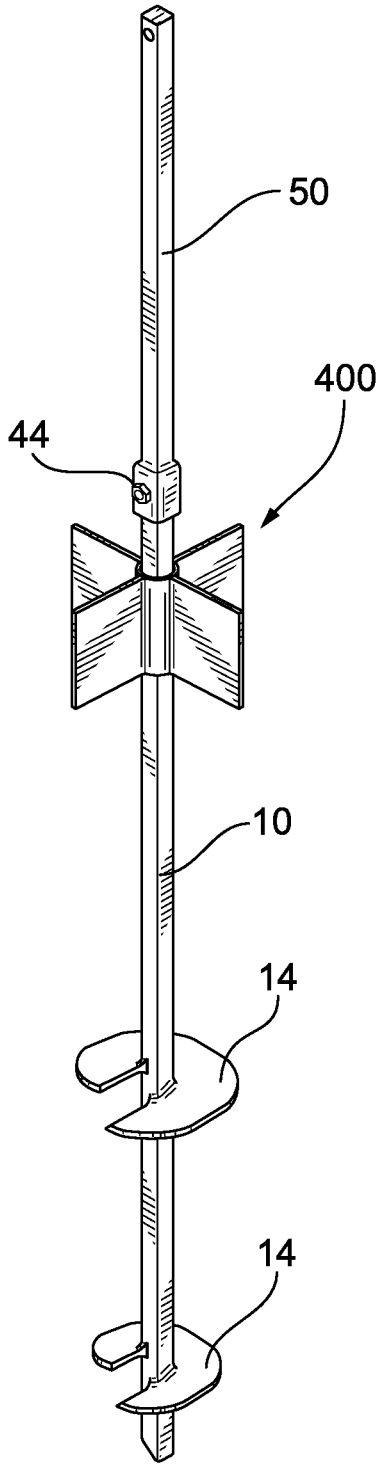
FIG. 36 is a perspective view of the lateral support structure according to an embodiment of the present disclosure on a lead shaft of a helical pile and with an extension shaft attached.

A lead shaft 10 including a lateral support structure 400 according to an illustrative embodiment of the present disclosure is shown in more detail in FIGS. 32-36. Lateral support structure 400 may be slid onto lead shaft 10. For example, lead shaft 10 includes lead head portion 24 that is the same dimension as the rest of the lead shaft 10. Accordingly, in this case, lateral support structure 400 can be easily slid onto lead shaft 10. Lead head portion 24 includes an orifice 25 for receiving a locking bolt for attaching an extension shaft. As shown in FIG. 34, center portion 408 of lateral support structure 400 is dimensioned to receive lead shaft 10 such that lead shaft 10 is capable of rotating within center portion 408.

Figure 37:
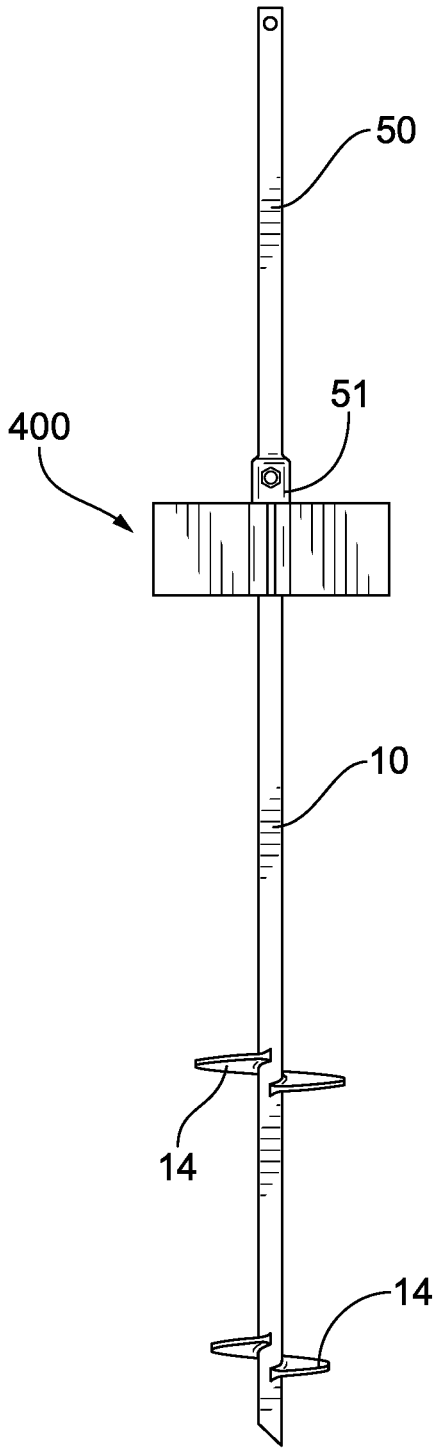
FIG. 37 is a side view of the lateral support structure according to an embodiment of the present disclosure on a lead shaft of a helical pile and with an extension shaft attached.
Figure 38:
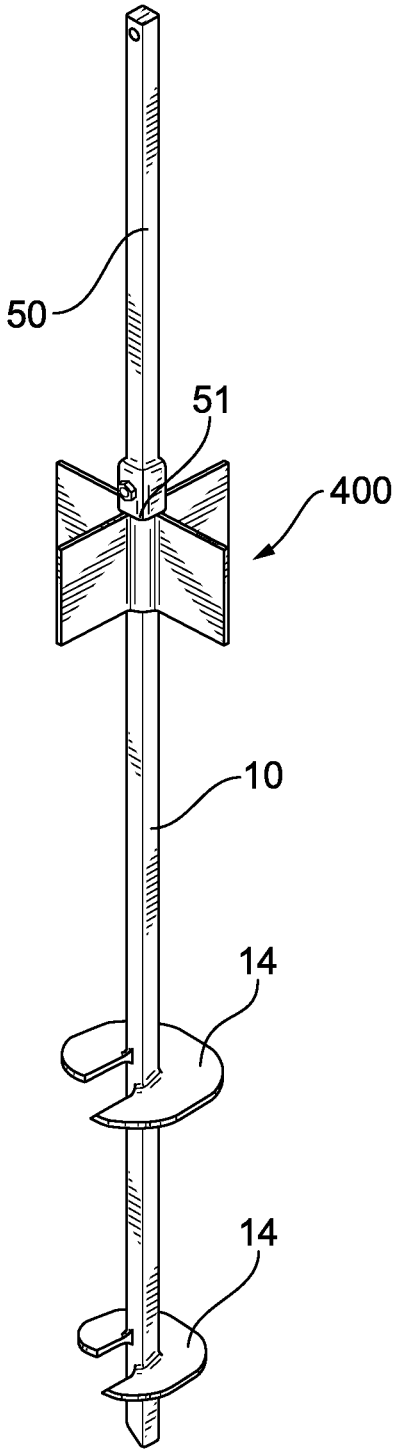
FIG. 38 is a perspective view of the lateral support structure according to an embodiment of the present disclosure on a lead shaft of a helical pile and with an extension shaft attached.

A lead shaft 10 having an extension shaft 50 mounted thereto and including a lateral support structure 400 according to an illustrative embodiment of the present disclosure is shown in FIGS. 35-38. Extension shaft 50 includes a distal end 42 having an opening dimensioned for receiving the lead head end 24 of lead shaft 10. Distal end 42 has an orifice extending there through corresponding to orifice 25 in lead shaft 10 (e.g., see FIG. 33) so that a locking bolt 44 can be passed through extension shaft 50 and lead shaft 10 and locked together with a locking nut (not shown). As extension shaft 50 and lead shaft 10 are rotated, helical plates 14 draw lead shaft 10 down into the ground. When lateral support structure 400 makes contact with the ground, lateral support structure 400 slides up lead shaft 10 until it abuts the union 51 between lead shaft 10 and extension shaft 50 as shown in FIGS. 37 and 38. As extension shaft 50 and lead shaft 10 are further rotated, lateral support structure 400 is driven into the ground to a desired depth.

Figure 39:
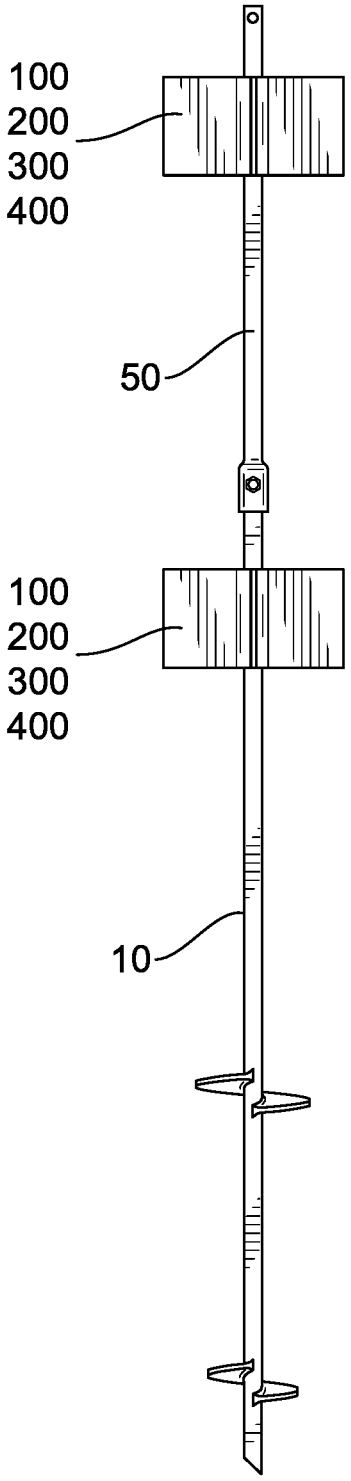
FIG. 39 is a side view of a pair of lateral support structures according to embodiments of the present disclosure on a lead shaft and extension shaft for a helical pile.
Figure 40:
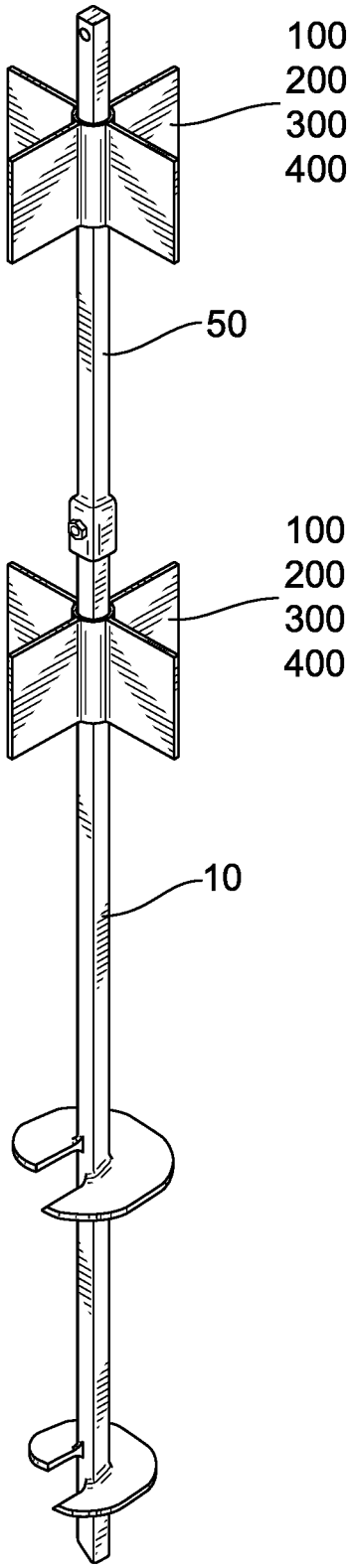
FIG. 40 is a perspective view of a pair of lateral support structures according to embodiments of the present disclosure on a lead shaft and an extension shaft for a helical pile.
Figure 41:
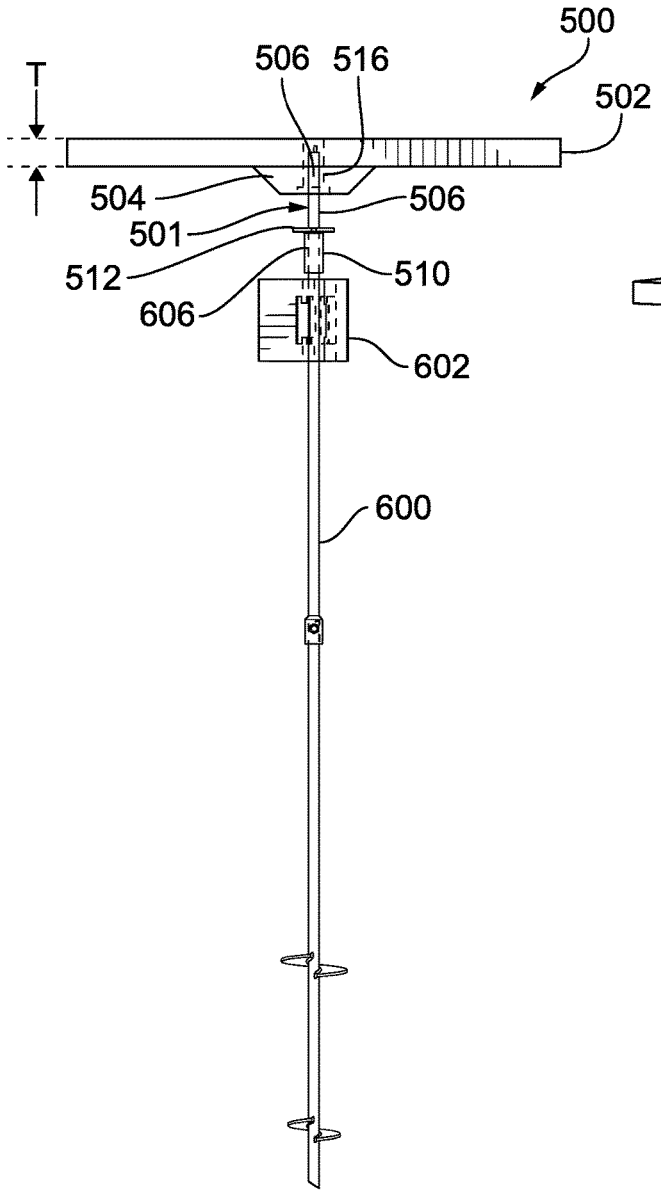
FIG. 41 is a side view of a structural support mounted to a helical pile including lateral support structures according to illustrative embodiments of the present disclosure.
Figure 42:
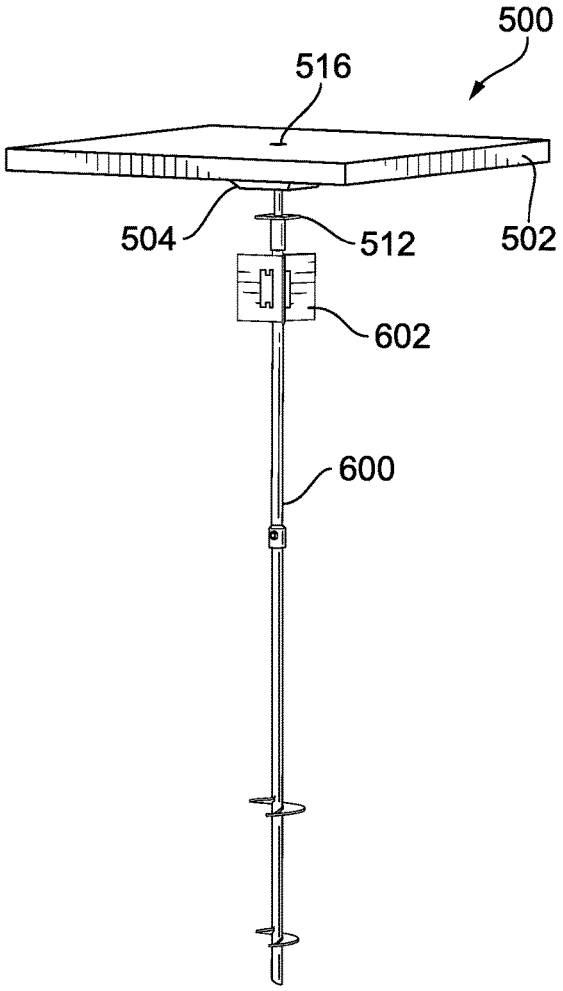
FIG. 42 is a perspective view of a structural support mounted to a helical pile including lateral support structures according to illustrative embodiments of the present disclosure.

The lateral support structures as described herein may be provided at several positions on the helical pile. For example, as shown in FIGS. 39 and 40, a lateral support structure (100, 200, 300, 400) such as one of those described above may be provided on one or more extension shafts 50 in addition to or instead of the one provided on lead shaft 10. In this way, lateral support can be provided to the shafts at different depths as may be desirable depending upon soil conditions.

According to illustrative embodiments of the present disclosure, structural supports may be added to the helical piles and lateral supports described herein and utilized to support foundational structures, such as for example concrete slabs, wood beams and metal beams. For ease of description, the present disclosure describes the structural supports in relation to concrete slabs. A structural support according to an illustrative embodiment of the present disclosure is depicted in FIGS. 41-45 and is referred to herein generally as support 500. The support 500 may comprise a jack plate assembly 501 used to mount a concrete slab 502 to a helical pile. The slab 502 has a base 504 extending therefrom and an orifice 516 extends through the slab and base. According to embodiments of the present disclosure as described herein, the supports 500 may be fabricated from a high strength, rigid material sufficient to support the foundational structure, e.g., a concrete slab. Non-limiting examples of such materials include steel and galvanized steel.

Figure 43:
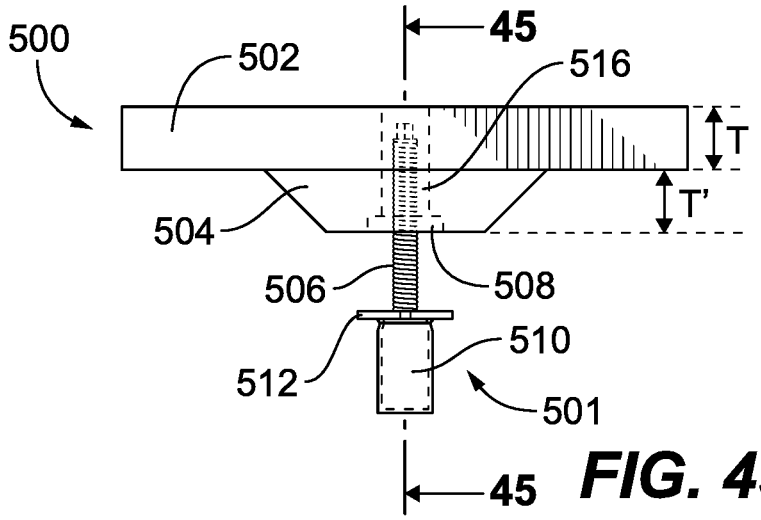
FIG. 43 is a side view of a structural support according to illustrative embodiments of the present disclosure.
Figure 44:
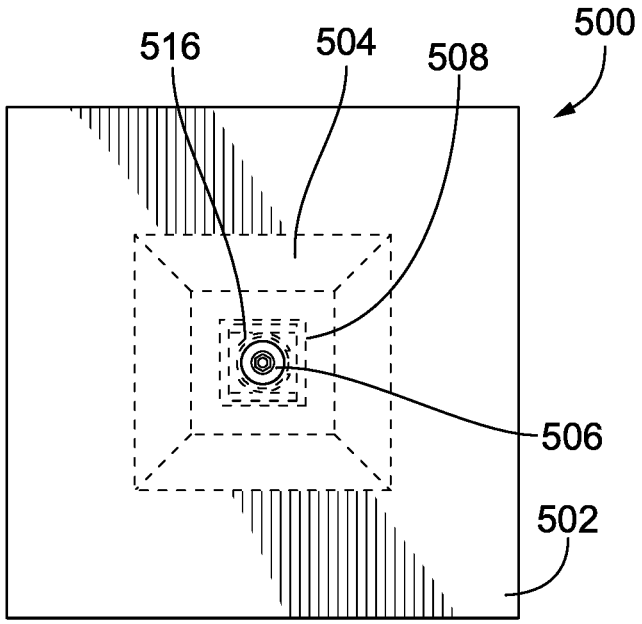
FIG. 44 is a top plan view of structural support according to illustrative embodiments of the present disclosure.
Figure 45:
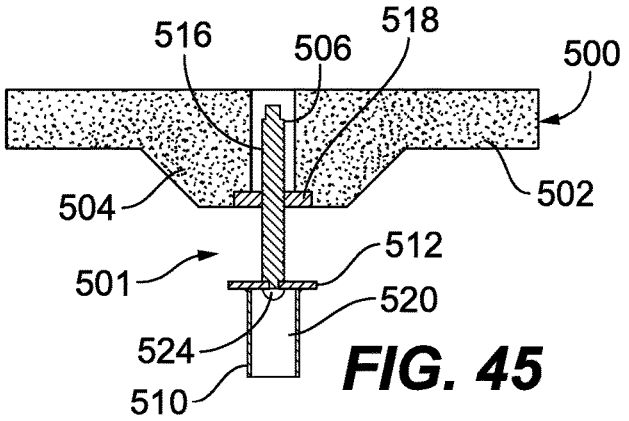
FIG. 45 is a side view of a structural support according to illustrative embodiments of the present disclosure.
Figure 46:
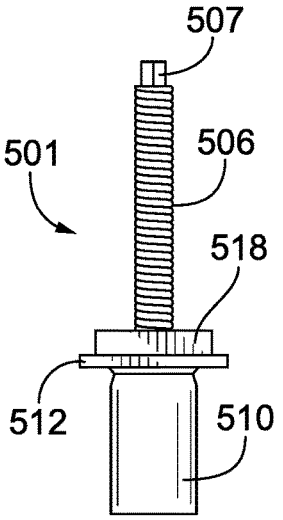
FIGS. 46-49 are side view of jack plate assemblies according to various illustrative embodiments of the present disclosure.
Figure 47:
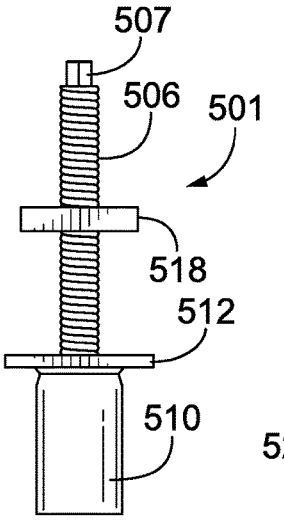

The jack plate assembly 501 according to an embodiment of the present disclosure is depicted in FIGS. 45-47. The jack plate assembly 501 includes a lower hollow receiver portion 510 including a space 520, seen in FIG. 45, dimensioned for receiving an end portion of a lead shaft or extension shaft extending above the ground. Hollow receiver portion 510 is generally cylindrical and round in cross section. However, it will be appreciated hollow receiver portion 510 may have a cross sectional shape other than round including square, rectangular, oval, triangular, etc. Plate 512 is welded or otherwise mounted to an end of hollow receiver portion 510. A threaded jack screw 506 includes a proximate end laterally restrained or otherwise positioned relative to the plate 512 and a distal end includes hexagonal head 507. A jack plate 518 has a threaded orifice extending there through and is capable of moving up and down jack screw 506 by rotation of the jack screw in the counter clockwise and clockwise directions. As depicted in FIGS. 43 and 45, slab 502 and base 504 have an orifice 516 extending there through for receiving the jack screw 506. According to an embodiment of the present disclosure, orifice 516 may be dimensioned to receive a socket wrench dimensioned to accept hexagonal head 507. The base 504 forms around jack plate 518 when the slab is poured or positioned relative to the jack plate assembly 501 so that the jack plate 518 supports the slab 502 and the base 504. The jack screw 506 can then be rotated in the clockwise or counter clockwise directions to adjust the height of slab 502.

Figure 48:
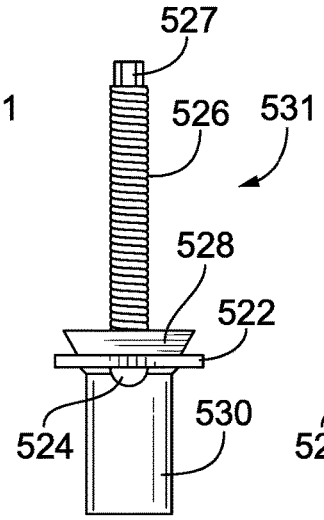
Figure 49:
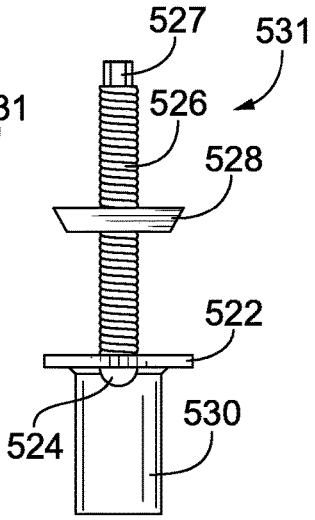
Figure 50:
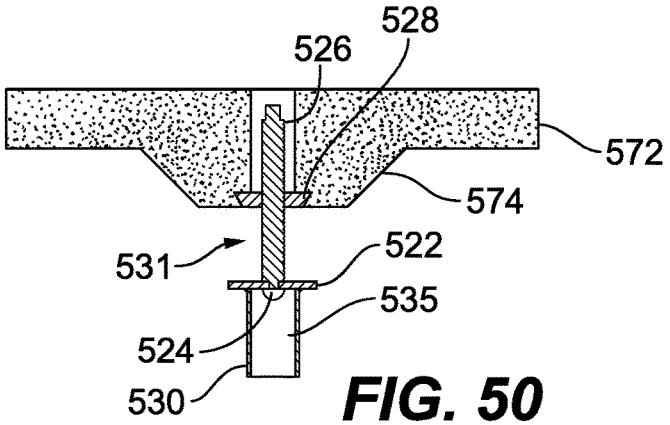
FIG. 50 is a side view of a structural support according to illustrative embodiments of the present disclosure.

A jack plate assembly 531 according to another illustrative embodiment of the present disclosure is depicted in FIGS. 48-50. The jack plate assembly 531 includes a lower hollow receiver portion 530 dimensioned for receiving an end portion of a lead shaft or extension shaft extending above the ground. The hollow receiver portion 530 is generally cylindrical and round in cross section. However, it will be appreciated hollow receiver portion 530 may have a cross sectional shape other than round including square, rectangular, oval, triangular, etc. Plate 522 is laterally restrained or otherwise positioned relative to the hollow receiver portion 530. A threaded jack screw 526 includes a proximate end welded or otherwise attached to plate 522 and a distal end includes a hexagonal head 527. A jack plate 528 has a threaded orifice extending there through and is capable of moving up and down jack screw 526 by rotating jack screw 526 in the counter clockwise and clockwise directions. As shown, the edges of jack plate 528 are tapered. Prior to pouring of the slab 572 and base 574, the jack plate 528 is positioned on the end portion of the lead shaft or extension shaft. The jack screw 526 can be rotated in the clockwise or counter clockwise directions to adjust the height of slab 572.

As noted above, the supports described herein may be fabricated from a high strength, rigid material, such as steel or galvanized steel. If made from galvanized steel, it is desirable to include an orifice 524 in hollow receiver portions 510 (FIG. 45), 530 (FIGS. 48-50). During the manufacturing process, the portions of the supports are hot dipped galvanized. Orifice 524 allows the liquid zinc to escape. Without the orifice 524, when the jack plate assembly 531 is dipped in the liquid zinc, the zinc could pool and solidify in hollow receiver portion 530 creating a "block". Since zinc is a relatively expensive material, such a "block" would result in a waste of money and could hinder the part from fully functioning since the "block" would act as an obstruction.

Figure 51:
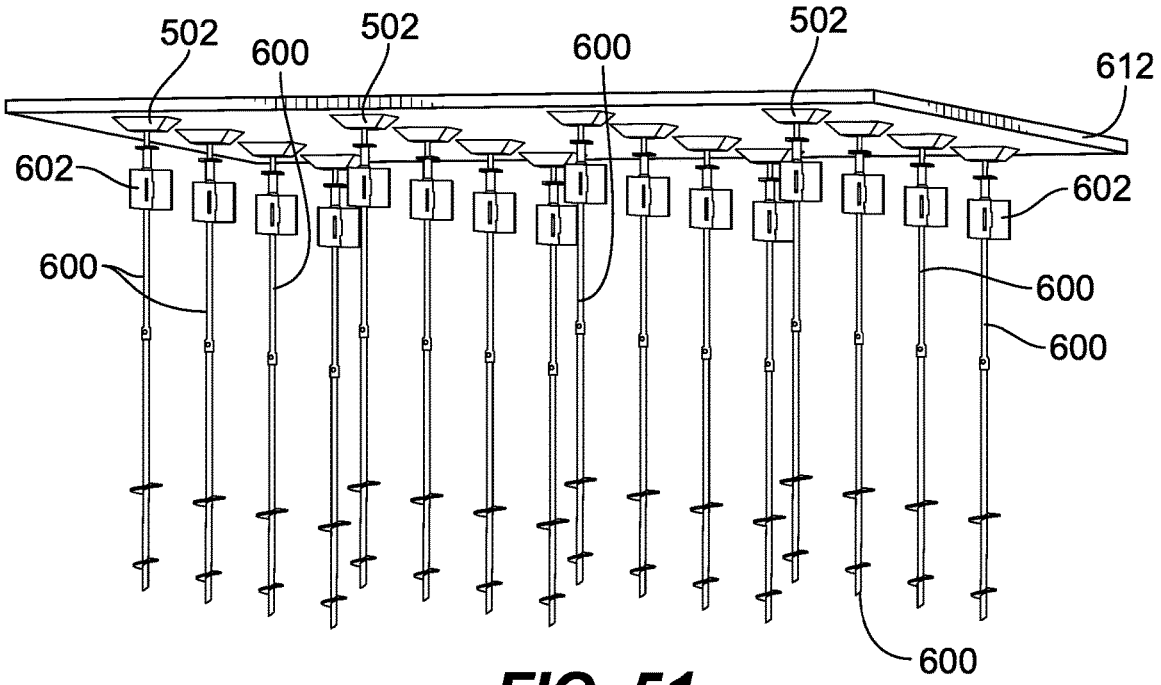
FIG. 51 is a perspective view of a plurality of structural supports arranged for supporting a structure.
Figure 52:
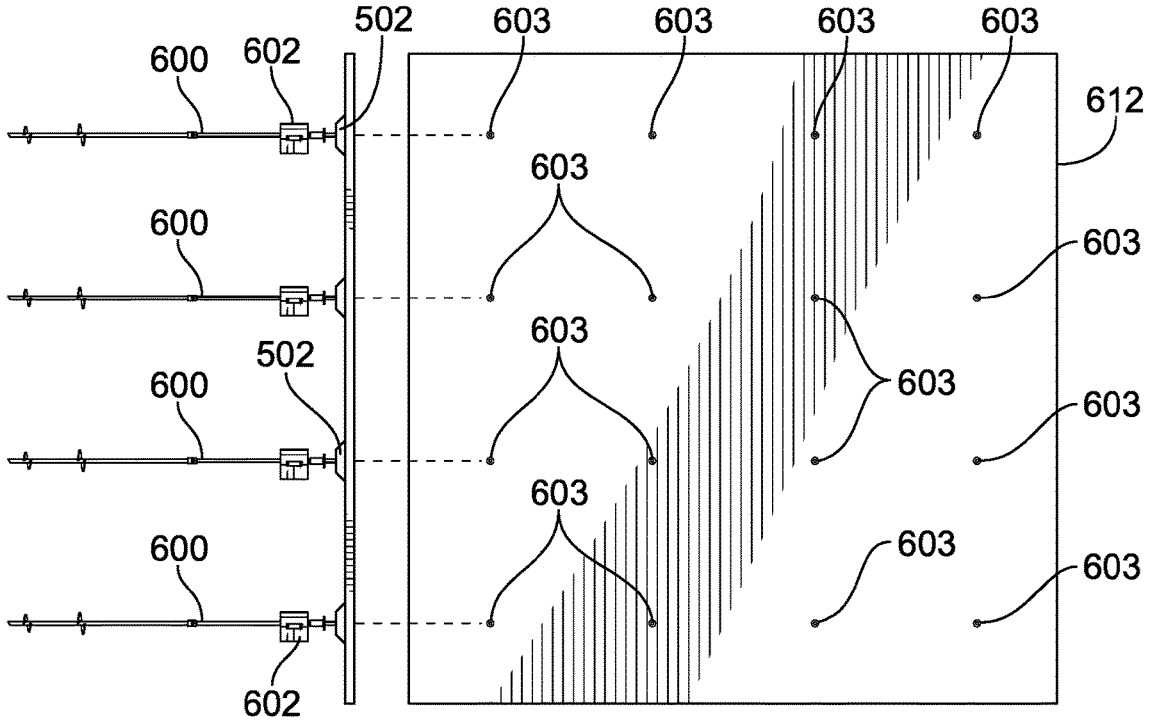
FIG. 52 are a side view and a top view for indicating placement of a plurality of structural supports for supporting a structure.

According to illustrative embodiments of the present disclosure, the helical piles and lateral supports along with the structural supports (e.g., support 500) described herein may be used to support relatively large structures or platforms. For example, as shown in FIGS. 51 and 52, a plurality of helical piles 600 including lateral supports 602 may be driven into the ground at suitable positions to support a concrete slab 612. For example, helical piles 600 are driven into the ground at positions corresponding to the points 603 indicated in FIG. 52. Holes may be provided at points 603 dimensioned for receiving a socket wrench sized to accept hexagonal head 507, 527 (see FIGS. 46-49). Supports including jack plate 518, 528 as described herein may then be placed on top of each pile 600 utilizing the jack screw mechanism described above. The slab 612 can then be poured around jack plate 518, 528. If necessary, utilizing the jack screw mechanism described above, a socket wrench can then be inserted through the holes at points 603 and onto hexagonal heads 507, 527 for rotating jack screws 506, 526 so that the slab 612 may be finely adjusted up or down. Platform 612 will thus be elevated above the soil surface and level.

The lateral supports as described herein effectively provide support to prevent or minimize lateral movement of the shafts in the soil. Utilizing lateral supports as described herein, the shafts for helical piles or anchors can be more effectively stabilized to provide a more secure base for structures. The particular configuration of the lateral supports as well as the diameters and/or shape of the openings in the center portions thereof for receiving the shafts, may depend upon the particular piles being utilized which will generally depend on the load the piles are to bear, and the soil conditions. Accordingly, it will be understood that various modifications can be made to the embodiments of the present disclosure herein without departing from the spirit and scope thereof. Therefore, the above description should not be construed as limiting the disclosure, but merely as embodiments thereof. Those skilled in the art will envision other modifications within the scope and spirit of the disclosure as defined by the claims appended hereto.

What is claimed is:

1. A lateral support for a shaft of a helical pile, the lateral support comprising:

a tubular portion for receiving the shaft; and a plurality of fins extending from the tubular portion;

wherein each of the plurality of fins includes an orifice and a tab;

wherein the orifice has a rectangular portion and a notch portion extending from opposite ends of the rectangular portion, wherein the rectangular portion has a first predetermined width, and wherein the rectangular portion and the notch portions have a second predetermined width, and wherein the first predetermined width is less that the second predetermined width; and wherein the tab has a neck and a pair of ears extending from opposite ends of the neck, the ears having a length that is less than a length of the neck so that a gap is formed between the one outer edges of the fin and the respective ear, wherein the neck has a third predetermined width, and wherein the neck and the pair of ears have a fourth predetermined width, wherein the third predetermined width is substantially the same as the first predetermined width and less than the fourth predetermined width; and wherein the fourth predetermined width is substantially the same as the second predetermined width such that the neck and pair of ears of one fin can fit within the second predetermined width of an orifice of an adjacent fin and the neck of the one fin can fit within the first predetermined width of the orifice of an adjacent fin.

2. The lateral support according to claim 1, wherein the tubular portion has a triangular cross-section.

3. The lateral support according to claim 1, wherein the tubular portion has a square cross-section.

4. The lateral support according to claim 1, wherein the tubular portion has a circular cross-section.

5. The lateral support according to claim 1, wherein each of the plurality of fins comprises an interlocking plate.

6. The lateral support according to claim 5, wherein the plurality of interlocking plates comprises three interlocking plates.

7. The lateral support according to claim 6, wherein the tubular portion is formed by interlocking the three interlocking plates.

8. The lateral support according to claim 7, wherein the interlocking plates cannot be released without removing the shaft from the tubular portion.

9. A structure for providing lateral support for a shaft of a helical pile, the structure comprising:

a plurality of interlocking members, each interlocking member having:

a plurality of outer edges;

an orifice extending through the interlocking member at a location on the member away from the plurality of outer edges, the orifice having a rectangular portion and a notch portion extending from opposite ends of the rectangular portion, wherein the rectangular portion has a first predetermined width, and wherein the rectangular portion and the notch portions have a second predetermined width, and wherein the first predetermined width is less that the second predetermined width; and a tab portion extending from one of the plurality of outer edges, the tab portion having a neck and a pair of ears extending from opposite ends of the neck, the ears having a length that is less than a length of the neck so that a gap is formed between the one of the plurality of outer edges and the respective ear, wherein the neck has a third predetermined width, and wherein the neck and the pair of ears have a fourth predetermined width, wherein the third predetermined width is substantially the same as the first predetermined width and less than the fourth predetermined width; and wherein the fourth predetermined width is substantially the same as the second predetermined width such that the neck and pair of ears of one interlocking member can fit within the second predetermined width of an orifice of an adjacent interlocking member and the neck of the one interlocking member can fit within the first predetermined width of the orifice of an adjacent interlocking member.

10. The structure according to claim 9, wherein the plurality of interlocking members when interlocked form an opening for receiving the shaft.

11. The structure according to claim 10, wherein the plurality of interlocking members cannot be unlocked without removing the shaft from the opening.

12. The structure according to claim 11, wherein the interlocking members comprise plates.

13. The structure according to claim 12, wherein the plates comprise at least one of steel and galvanized steel.

14. The structure according to claim 10, wherein the opening has a triangular cross-section.

* * * * *